US005765071A

United States Patent [19]

Kinoshita et al.

[11] Patent Number: 5,765,071

[45] Date of Patent: Jun. 9, 1998

[54] PROCESSING LIQUID STORAGE APPARATUS IN AUTOMATIC DEVELOPER SYSTEM, AND PHOTOGRAPHIC PROCESSING APPARATUS

[75] Inventors: Togo Kinoshita; Masaaki Tamura; Hiroaki Wada, all of Wakayama, Japan

[73] Assignee: Noritsu Koki Co., Ltd., Wakayama, Japan

[21] Appl. No.: 734,185

[22] Filed: Oct. 21, 1996

[30] Foreign Application Priority Data

| | | | |
|---|---|---|---|
| Oct. 23, 1994 | [JP] | Japan | 7-274534 |
| Oct. 19, 1995 | [JP] | Japan | 7-271237 |
| Oct. 23, 1995 | [JP] | Japan | 7-274533 |
| Oct. 23, 1995 | [JP] | Japan | 7-274535 |
| Oct. 23, 1995 | [JP] | Japan | 7-274536 |
| Feb. 15, 1996 | [JP] | Japan | 8-028135 |

[51] Int. Cl.[6] ..... G03D 3/02

[52] U.S. Cl. ..... 396/626; 396/641

[58] Field of Search ..... 396/626, 630, 396/636, 627, 641; 222/95, 135, 255, 206, 213, 214; 141/114

[56] References Cited

U.S. PATENT DOCUMENTS

| | | | |
|---|---|---|---|
| 4,533,225 | 8/1985 | Shiga | 396/626 |
| 4,734,728 | 3/1988 | Muller | 396/641 |
| 4,958,666 | 9/1990 | Kocourek et al. | 396/641 |

FOREIGN PATENT DOCUMENTS

| | | |
|---|---|---|
| 0 629 916 | 12/1994 | European Pat. Off. . |
| 38 39 845 | 5/1990 | Germany . |

OTHER PUBLICATIONS

Patent Abstracts of Japan, vol. 12, No. 406 (P-777), 27 Oct. 1988 & JP 63 143550 A (Konica), 15 Jun. 1988, * abstract *.

*Primary Examiner*—D. Rutledge

*Attorney, Agent, or Firm*—Wenderoth, Lind & Ponack

[57] ABSTRACT

A processing liquid cartridge storage apparatus in an automatic development processing system for automatically developing photosensitive materials includes a processing liquid cartridge(s) filled with at least two or more separately stored, different processing liquids and detachably loaded onto a cartridge bed plate installed in the automatic development processing system. The processing liquid cartridge is equipped with outlet nozzles extending from its processing liquid chambers an arranged to fit into corresponding apertures provided in the cartridge bed plate. A slide plate is slidably mounted beneath the cartridge bed plate and has at least two connected hole pairs provided therein at equal intervals.

12 Claims, 38 Drawing Sheets

PROCESSING LIQUID STORAGE APPARATUS IN AUTOMATIC DEVELOPER SYSTEM, AND PHOTOGRAPHIC PROCESSING APPARATUS

BACKGROUND OF THE INVENTION

The present invention relates to a processing liquid cartridge storage apparatus provided for storage of a processing liquid cartridge(s) filled with separately stored, different processing liquids in an automatic development processing system which develops silver halide photosensitive materials such as photographic film or paper (referred to as photosensitive materials hereinafter).

A variety of automatic development processing systems are known including a type for developing photographic film, a type for developing photographic paper, a type for developing both photographic film and paper, or a type for their combination accompanied with a photographic printing system.

In a conventional automatic development processing system comprising a photographic printing machine and an automatic photographic paper development processing machine, a photographic material is exposed to image light of an original at the printing machine and then is subjected to development, desilvarization, rinsing, and stabilization at the development processing machine. Such operations are carried out using different processing liquids which thus decline in quality and quantity as the operations are repeated. It is hence essential for maintaining the processing operations at a desired degree of performance to replenish the processing liquids from time to time. For replenishing, the processing liquids are generally stored in separate supply tanks a respectively as shown in FIG. 44. The supply tanks a are stored in a particular location of the automatic development processing system which may vary depending on its type. When an openable cover b for the supply tanks a is opened, processing liquid inlets c of their respective supply tanks a are exposed.

The operation of replenishing a processing liquid starts with a sensor (not shown) detecting shortage of the processing liquid in the automatic development processing system, opening an inlet lid d of the target supply tank a, and preparing a container (not shown) filled with the desired processing liquid, pouring the processing liquid from the container through the inlet c into the supply tank a, adding an amount of water, and stirring a mixture of the processing liquid and water with a stirring rode.

Also, for ease of replenishing, a cartridge filled with different processing liquids stored separately has recently been developed and introduced. The cartridge filled with the different processing liquids is readily loaded into a cartridge storage apparatus of the automatic development processing system for feeding the processing liquids.

For such purpose, the cartridge has outlet nozzles extending from separately mounted, different processing liquid chambers thereof and allows them to be connected with corresponding delivery nozzles mounted in the cartridge storage apparatus for supplying the processing liquids to development processing units in the automatic development processing system.

A conventional photographic processing apparatus also includes a group of supply tanks for carrying the different processing liquids such as a developer and a bleacher. As the processing liquids are consumed, their supply tanks are replenished with the help of a stirring means. However, the supply tanks of the photographic processing apparatus when replenished with the processing liquids have to be subjected to a stirring operation which is troublesome. Replenishing often results in messing the hands of an operator.

For compensation, a processing liquid cartridge filled with the processing liquids is loaded on a drawer base of the photographic processing apparatus. The cartridge when exhausted is simply replaced with a new cartridge. More specifically, the photographic processing apparatus of such a type is shown in FIG. 45 where a drawer base 4B is installed for movement to and from a drawer base storage 4A in the apparatus and has an openable door 4D. A processing liquid cartridge 4C is then loaded onto the drawer base 4B which has been moved from storage 4A. The openable door 4D is integrally mounted to the front of the drawer base 4B. When the drawer base 4B is moved into the drawer base storage 4A, the openable door 4D shuts the drawer base storage 4A and simultaneously locks the drawer base 4B with a lock mechanism 4E mounted thereon. Accordingly, the drawer base 4B is prevented from moving out from the drawer base storage 4A when not desired.

Since the processing liquids include a developer, a bleacher, a fixer, a stabilizer, and other agents, two or more respective supply tanks a are used. It is thus not an easy task for replenishing the plural tanks with the different processing liquids and adding respective amounts of water. This may result in filling with an improper processing liquid or an error in the filling amount. Also, upon adding water, a resultant mixture has to be adequately stirred with a stirring rod e at each filling process. The stirring repeated at the filling processes of the different processing liquids requires a manual operation by the operator and hence increases the overall development process time. It may also happen that traces of the processing liquid are splashed out during the filling into the supply tank. The filling of the supply tanks with their respective processing liquids is both costly and time-consuming, creating downtime and hence increasing the overall operating time of the automatic development processing system. It is possible for minimizing the downtime by ensuring that filling is carried out by a skilled operator but not everybody is so skilled.

The use of a processing liquid cartridge is implemented in view of the foregoing aspects. The cartridge filled with the separately stored processing liquids is loaded onto the automatic development processing system and when exhausted, is replaced with a new cartridge thus eliminating the above problems.

The cartridge is commonly made of a soft synthetic resin material and thus may cause the outlet nozzles to be projected not in correct alignment and to extend downwardly at more or less different angles to the perpendicular. Accordingly, the outlet nozzles extending from the cartridge are substantially misaligned with the corresponding delivery nozzles to be connected and when they are joined to each other, some of their joints may produce leakage of the processing liquids.

The conventional photographic processing apparatus allows the drawer base 4B to be formed integral with the openable door 4D the upper end of which is higher than the drawer base 4B (FIG. 45). Accordingly, the openable door 4D may disturb the replacement of the processing liquid cartridge 4C.

Also, the lock mechanism 4E is mounted to the openable door 4D which is rather low in structural rigidity and may easily be deformed by the weight of the drawer base 4B. This will result in locking errors.

It is an object of the present invention, for solving the above drawbacks, to provide a processing liquid cartridge storage apparatus for use in an automatic development processing system of any type for developing photosensitive materials, in which when a cartridge filled with different processing liquids stored separately is loaded on a cartridge bed plate outlet nozzles extending from processing liquid chambers of the cartridge respectively are securely joined at the same time to the cartridge bed plate.

It is another object of the present invention to provide a processing liquid cartridge storage apparatus for use in an automatic development processing system of any type for developing photosensitive materials, in which outlet nozzles extending from respective chambers of a cartridge filled with different processing liquids are connected readily and correctly at the same time to and disconnected from corresponding delivery nozzles located beneath.

It is a further object of the present invention to provide a processing liquid cartridge storage apparatus for use in an automatic development processing system of any type for developing photosensitive materials, in which outlet nozzles extending from respective chambers of a cartridge filled with different processing liquids are correctly positioned at the same time to corresponding locations.

It is a still further object of the present invention to provide a processing liquid cartridge storage apparatus for use in an automatic development processing system of any type for developing photosensitive materials, in which loading to a predetermined location of a cartridge filled with different processing liquids stored separately is detected mechanically and electrically, whereby faulty loading will be prevented.

It is a still further object of the present invention, for solving the above drawbacks, to provide a processing liquid cartridge storage apparatus for use in an automatic development processing system of any type for developing photosensitive materials, in which when a cartridge filled with different processing liquids stored separately is loaded on a cartridge bed plate, outlet nozzles extending from respective processing liquid chambers of the cartridge are correctly connected at the same time to corresponding delivery nozzles located therebeneath without producing leakage from any connected joints.

Other objects of the present invention are enable to replacement of the processing liquid cartridge with a new one without being disturbed by openable doors and to eliminate locking error of a drawer base.

SUMMARY OF THE INVENTION

For achievement of the above objects of the present invention, the following are provided.

A processing liquid cartridge storage apparatus in an automatic development processing system for automatically developing photosensitive materials according to the present invention includes a processing liquid cartridge(s) filled with at least two or more separately stored, different processing liquids and detachably loaded onto a cartridge bed plate installed in the automatic development processing system. The processing liquid cartridge is equipped with outlet nozzles extending from its processing liquid chambers and arranged to fit into corresponding apertures provided in the cartridge bed plate. A slide plate is slidably mounted beneath the cartridge bed plate and has at least two or more hole pairs or pairs of connected holes provided therein at equal intervals. Each hole pair includes an outlet nozzle accepting hole for accepting the corresponding outlet nozzle and an outlet nozzle engaging hole communicated with the outlet nozzle accepting hole. When the outlet nozzles of the processing liquid cartridge are lowered at once through the corresponding apertures of the cartridge bed plate into the outlet nozzle accepting holes of the slide plate, the slide plate is slid forward to allow inner edges at the outlet nozzle engaging holes to engage with annular recesses provided in the periphery of the outlet nozzles, thus securing at the same time all of the outlet nozzles of the processing liquid cartridge to the cartridge bed plate.

A processing liquid cartridge storage apparatus in an automatic development processing system for automatically developing photosensitive materials according another aspect of to the present invention includes a processing liquid cartridge(s) filled with at least two or more separately stored, different processing liquids and detachably loaded onto a cartridge bed plate installed in the automatic development processing system. The processing liquid cartridge is equipped with outlet nozzles extending from its processing liquid chambers and arranged to fit into corresponding apertures provided in the cartridge bed plate. A support member carrying a group of processing liquid deliver nozzles thereon corresponding to the outlet nozzles fitted in the apertures of the cartridge bed plate is arranged to be moved up and down by a lifting means, whereby when the support member is lifted up, all of the delivery nozzles are securely connected at the same time to the corresponding outlet nozzles of the processing liquid cartridge.

A processing liquid cartridge storage apparatus in an automatic development processing system according to a further aspect of the present invention includes a processing liquid cartridge(s) filled with at least two or more separately stored, different processing liquids and detachably loaded onto a cartridge bed plate installed in the automatic development processing system. The processing liquid cartridge is equipped with outlet nozzles extending from its processing liquid chambers and arranged to fit into corresponding apertures provided in the cartridge bed plate. A support member carrying a group of processing liquid delivery nozzles thereon corresponding to the outlet nozzles fitted in the apertures of the cartridge bed plate is mounted stationary beneath the cartridge bed plate. The cartridge bed plate is arranged to be moved up and down by a lifting means, whereby when the cartridge bed plate is moved down, all of the outlet nozzles of the processing liquid cartridge are securely connected at the same time to the corresponding delivery nozzles of the support member.

A processing liquid cartridge storage apparatus in an automatic development processing system according to another aspect of the present invention includes a processing liquid cartridge(s) filled with at least two or more separately stored, different processing liquids and detachably loaded onto a cartridge bed plate installed in the automatic development processing system. The processing liquid cartridge is equipped with outlet nozzles extending from its processing liquid chambers and arranged to fit into corresponding apertures provided in the cartridge bed plate. A group of guide members are mounted corresponding to the apertures of the cartridge bed plate. Each guide member has provided therein an outlet nozzle accepting hole having an inner guiding edge that is beveled for ease of insertion of the corresponding outlet nozzle, whereby all of the outlet nozzles of the processing liquid cartridge are correctly fitted at the same time into the corresponding apertures of the cartridge bed plate.

A processing liquid cartridge storage apparatus in an automatic development processing system according to a further aspect of the present invention includes a processing liquid cartridge(s) filled with at least two or more separately stored, different processing liquids and detachably loaded onto a cartridge bed plate installed in the automatic development processing system. The processing liquid cartridge is equipped with outlet nozzles extending from its processing liquid chambers and arranged to fit into corresponding apertures provided in the cartridge bed plate. A slide plate is slidably mounted beneath the cartridge bed plate and has at least two or more hole pairs or pairs of connected holes provided therein at equal intervals. Each hole pair includes an outlet nozzle accepting hole for accepting the corresponding outlet nozzle and an outlet nozzle engaging hole communicated with the outlet nozzle accepting hole. The slide plate has a contact tab provided on the lower side thereof. A support member is mounted beneath the slide plate, is equipped with processing liquid delivery nozzles corresponding to the outlet nozzles, and has a stopper tab provided on the upper side thereof. When the outlet nozzle accepting holes of the slide plate are aligned with the corresponding apertures of the cartridge bed plate, the slide plate causes the contact tab to hold the stopper tab, thus preventing upward movement of the support member. When the slide plate is slid forward to align the outlet nozzle engaging holes with the apertures of the cartridge bed plate and to hold with inner edges of the outlet nozzle engaging holes the outlet nozzles of the processing liquid cartridge, the contact tab departs from the stopper tab of the support member, thus allowing the support member to move upward.

A processing liquid cartridge storage apparatus in an automatic development processing system according to another aspect of the present invention includes a processing liquid cartridge(s) filled with at least two or more separately stored, different processing liquids and detachably loaded onto a movable cartridge bed plate installed in the automatic development processing system. The processing liquid cartridge is equipped with outlet nozzles extending from its processing liquid chambers and arranged to fit into corresponding apertures provided in the cartridge bed plate. A slide plate is slidably mounted beneath the cartridge bed plate and has at least two or more hole pairs or pairs of connected holes provided therein at equal intervals. Each hole pair includes an outlet nozzle accepting hole for accepting the corresponding outlet nozzle and an outlet nozzle engaging hole communicated with the outlet nozzle accepting hole. The slide plate has a contact tab provided on the lower side thereof. A support member is mounted stationary beneath the slide plate, is equipped with processing liquid delivery nozzles corresponding to the outlet nozzles, and has a stopper tab provided on the upper side thereof. When the outlet nozzle accepting holes of the slide plate are aligned with the corresponding apertures of the cartridge bed plate, the slide plate causes the contact tab to engage with the stopper tab, thus preventing downward movement of the cartridge bed plate. When the slide plate is slid forward to align the outlet nozzle engaging holes with the apertures of the cartridge bed plate and to hold with inner edges of the outlet nozzle engaging holes the outlet nozzles of the processing liquid cartridge, the contact tab departs from the stopper tab of the support member, thus allowing the cartridge bed plate to move downward.

The processing liquid cartridge storage apparatus may include a sensor mounted on the support member and/or the cartridge bed plate for detecting the upward movement of the support member to a predetermined level or the downward movement of the cartridge bed plate to a predetermined level.

In a processing liquid cartridge storage apparatus of an aspect of the invention, when a processing liquid cartridge having a group of outlet nozzles extending from different processing liquid chambers thereof arranged separately is loaded onto a cartridge bed plate which is formed with apertures corresponding to the outlet nozzles, the outlet nozzles, each having an annular recess provided in the periphery thereof, are fitted into the corresponding apertures of the cartridge bed plate, secured with a securing means to the cartridge bed plate, and joined at the same time with processing liquid delivery nozzles mounted on a support member beneath the cartridge bed plate by a moving means moving upward the support member with the delivery nozzles or downward the cartridge bed plate with the outlet nozzles. Fitting members can be mounted on the lower side of the cartridge bed plate. Each fitting member is located about a respective aperture of the cartridge bed plate and has a horse-shoe shape arranged for detachably fitting into the annular recess of a corresponding outlet nozzle. A slide member is slidably mounted beneath the cartridge bed plate and has outlet nozzle holes provided therein. The outlet nozzles of the processing liquid cartridge are lowered into the apertures of the cartridge bed plate and the outlet nozzle holes of the slide plate and are securely joined to the cartridge bed plate when the slide plate is slid forward to hold the annular recess of each outlet nozzle from one direction with the inner edge of the outlet nozzle hole of the slide plate and from the other three directions with the fitting member.

The processing liquid cartridge storage apparatus may include guide members mounted stationary beneath the cartridge bed plate. Each guide member is located about a respective aperture of the cartridge bed plate and has an outlet nozzle through hole provided therein for positioning the respective outlet nozzle. Holding members are movably mounted on the support member. Each holding member is arranged to accept the outlet nozzle and is joined with the corresponding delivery nozzle. The outlet nozzles of the processing liquid cartridge held and positioned with the respective guide members are securely connected by operation of the lifting means to the corresponding delivery nozzles which are aligned by displacement of the holding members upon the delivery nozzles moving into the holding members.

The processing liquid cartridge storage apparatus may include guide members movably mounted beneath the cartridge bed plate. Each guide member is located about a respective aperture of the cartridge bed plate and has an outlet nozzle through hole provided therein for positioning the respective outlet nozzle. Engaging members are movably mounted on the support member. Each engaging member is arranged to engage with the lower side of a respective guide member and is joined with a corresponding delivery nozzle. The outlet nozzles of the processing liquid cartridge are securely connected to the corresponding delivery nozzles by operation of the lifting means causing the engagement of each movable guide member with the corresponding engaging member for precise alignment.

A photographic processing apparatus according to a further aspect of the present invention includes a drawer base storage arranged in a housing, one side of which is formed with a storage opening. Opening and closing doors are mounted to the housing for closing the storage opening of the drawer base storage. A drawer base on which a processing liquid tank is loaded is installed in the drawer base storage for inward and outward movements through the storage opening. A pair of engaging members, one mounted on the drawer base and the other mounted in the drawer base storage, are engaged with each other to lock the drawer base when the drawer base is moved into the drawer base storage.

DETAILED DESCRIPTION OF THE PREFERRED EMBODIMENTS

Embodiment 1

Figure 1:
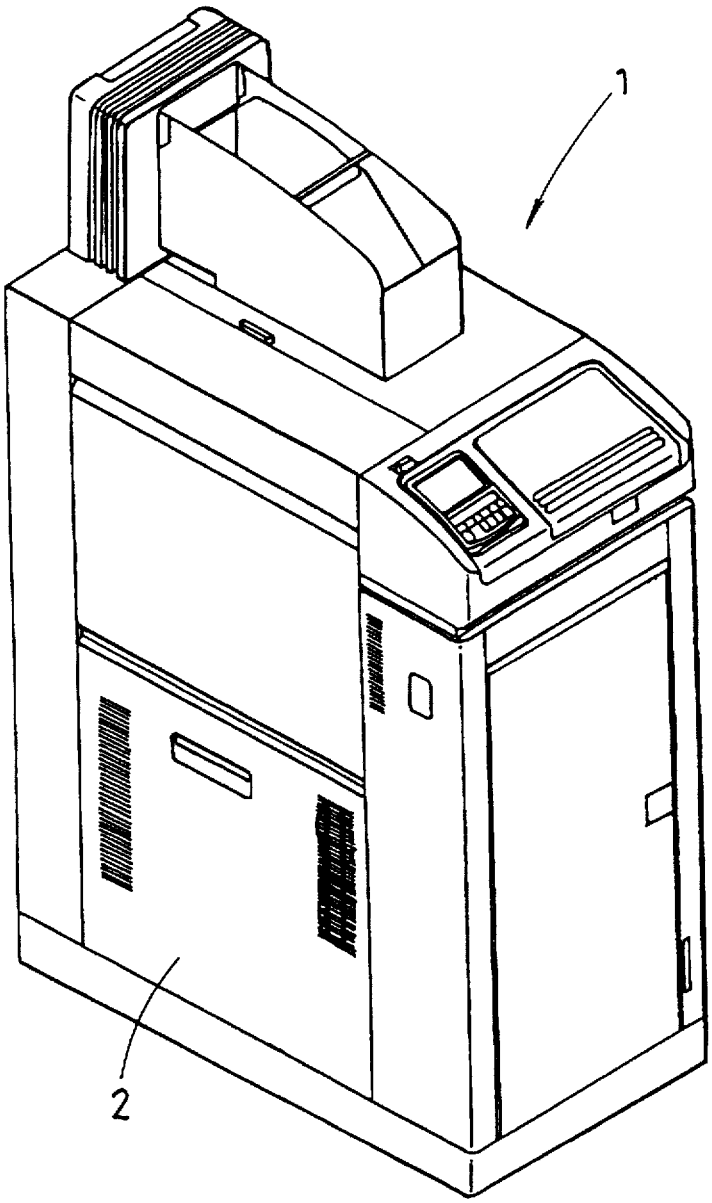
FIG. 1 is a perspective view of an automatic development processing system in which a processing liquid cartridge storage apparatus according to the present invention is installed.
Figure 2:
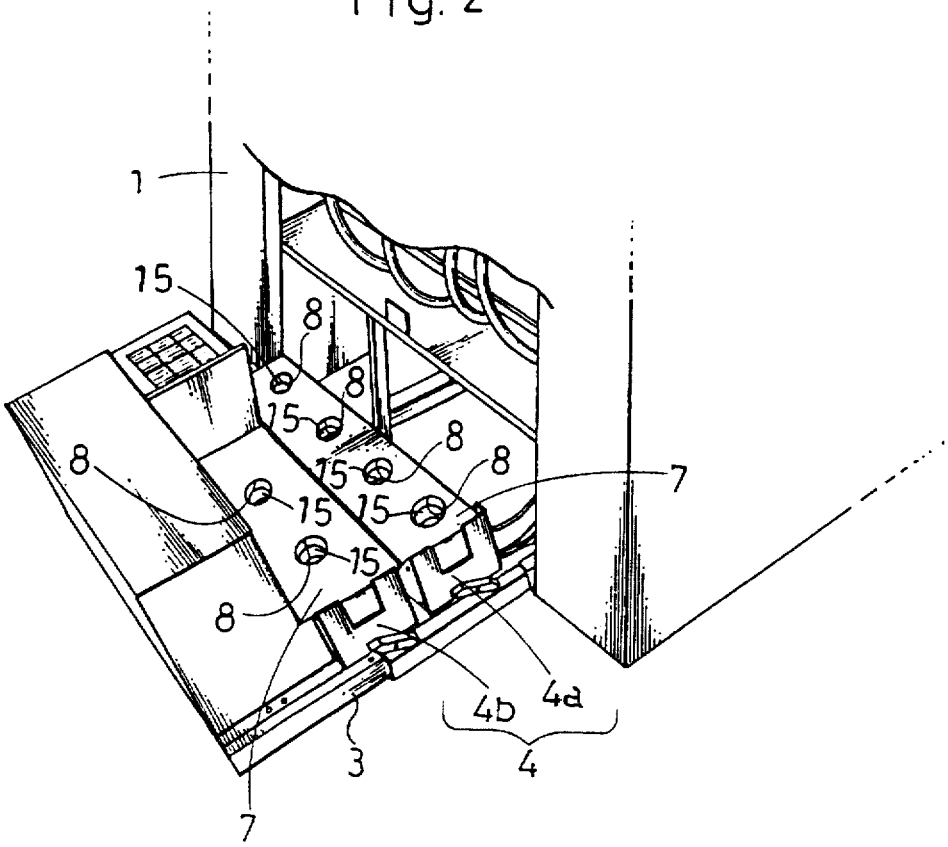
FIG. 2 is a perspective view of the processing liquid cartridge storage apparatus drawn out from the automatic development processing system.
Figure 3:
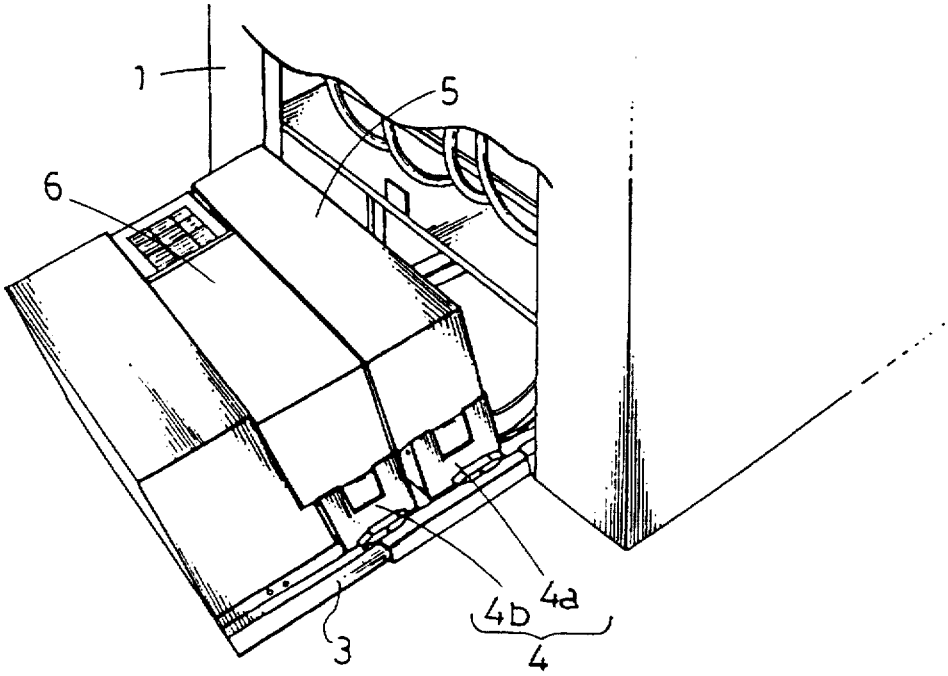
FIG. 3 is a perspective view showing the processing liquid cartridge storage apparatus of FIG. 2 in two units and on which respective processing liquid cartridges are loaded.

FIG. 1 is a perspective view of an automatic development processor machine 1 for photographic films, including an opening/closing door 2 which is located on a side-thereof and which is opened when pulled. On the inner side of the door 2 is a drawer platform or base 3 having rollers (not shown) on both sides thereof as illustrated in FIGS. 2 and 3.

A processing liquid cartridge storage apparatus 4 is mounted on the upper surface of the drawer platform 3. As shown in FIG. 3, this embodiment employs a pair of processing liquid cartridge storage apparatuses **4*a* and 4*b* to which a processing liquid cartridge 5 filled with four different processing liquids separately and a processing liquid cartridge 6** filled with two different processing liquids separately are loaded respectively.

Figure 4:
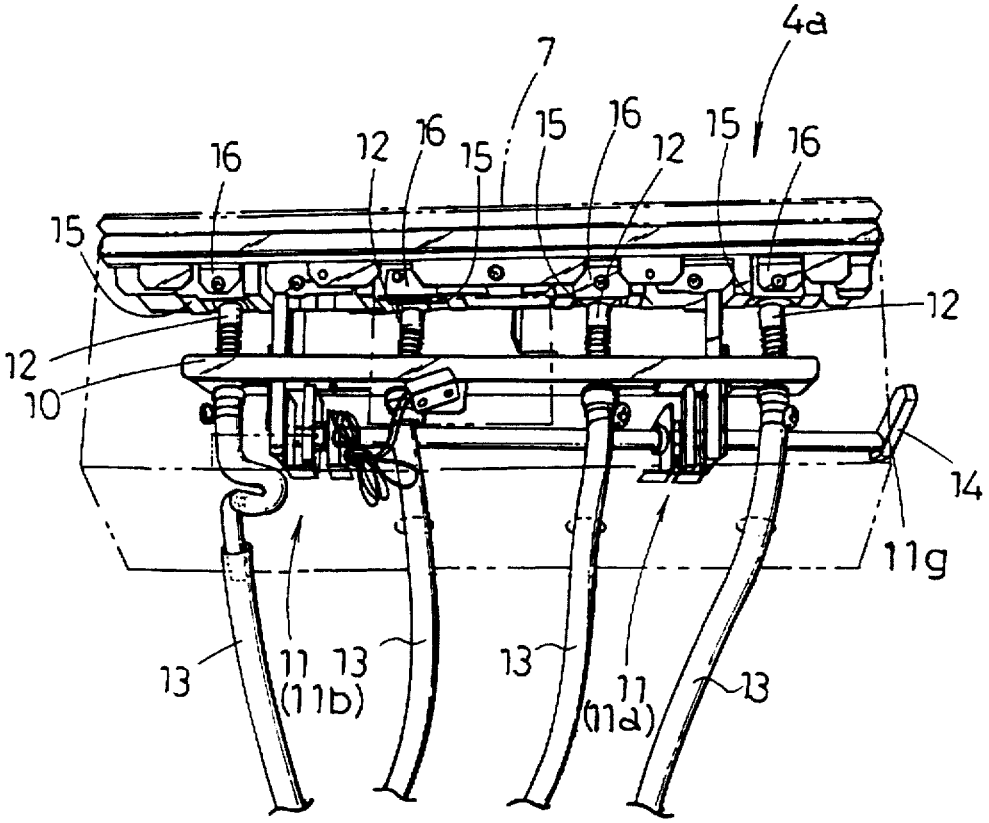
FIG. 4 is a perspective view showing an interior of the processing liquid cartridge storage apparatus.

Each of the processing liquid cartridge storage apparatuses **4*a* and 4*b* is shaped as a parallelepiped incorporating a variety of components as shown in FIG. 4 (depicting apparatus 4*a*). The processing liquid cartridge storage apparatus 4b is arranged to carry the processing liquid cartridge 6 containing the two processing liquids separately and thus has a construction similar to a half of that of the processing liquid cartridge storage apparatus 4a**.

Figure 5:
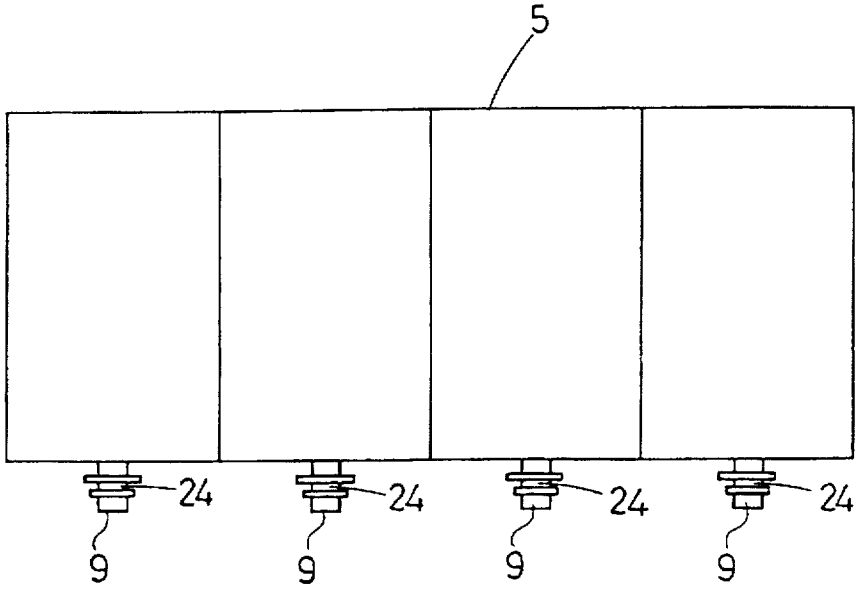
FIG. 5 is a schematic front view of the processing liquid cartridge.

As shown in FIGS. 4 and 5, the processing liquid cartridge storage apparatus 4a comprises a cartridge bed plate 7 located at the top thereof. The cartridge bed plate 7 has a row of through apertures 8 (FIG. 2) provided therein at equal intervals. The apertures 8 are arranged to accept corresponding outlet nozzles 9 of the processing liquid cartridge 5 which is loaded onto the cartridge bed plate 7. The processing liquid cartridge storage apparatus 4a is provided with a support member 10 (FIG. 4) which is located in a center region thereof extending lengthwisely and can be moved up and down by a lifting means 11. Delivery nozzles 12 for corresponding processing liquids are mounted to the support member 10 so that they are aligned with respective of the apertures 8. Each delivery nozzle 12 is connected to a conduit 13. The support member 10 is lifted up to a predetermined level by an operating lever 14 and is moved back to a home position thereby. Guide or fitting members 15 are fixedly mounted by retainers 16 (FIG. 4) to the lower surface of the cartridge bed plate 7 to be spaced by a few millimeters from the cartridge bed plate 7 for guiding the outlet nozzles 9 of the processing liquid cartridge 5 through the corresponding apertures 8.

A slide plate 17 shown in FIGS. 6 to 9 is slidably interposed between the cartridge bed plate 7 and the guide members 15. The slide plate 17 is a narrow rectangular strip having two lengthwisely extending slots 18 provided therein. Two stud bolts 19 (FIG. 9) mounted to the lower surface of the cartridge bed plate 7 are inserted into respective of the slots 18 of the slide plate 17. More specifically, a collar 20 having a radially reduced region 20a which can thus be accepted in the slot 18 is fitted onto each of the, stud bolts 19 and is held by a retainer nut 21 threaded an the distal end of the stud bolt 19. This allows the slide plate 17 to slide along the lower surface of the cartridge bed plate 7. The slide plate 17 has four outlet nozzle holes 22 provided therein at equal intervals for holding at once the outlet nozzles 9 of the processing liquid cartridge 5 (FIG. 5) extending through the corresponding apertures 8 of the cartridge bed plate 7 (FIG. 2), each outlet nozzle hole 22 communicating with an outlet nozzle holding hole 23 thus to form a hole pair or pair of connected holes.

Figure 7:
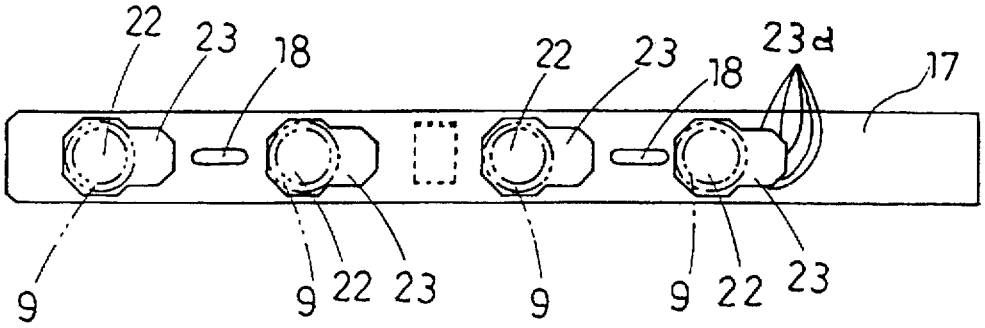
FIG. 7 is a plan view of a slide plate having outlet nozzle accepting holes holding corresponding outlet nozzles 9.
Figure 8:
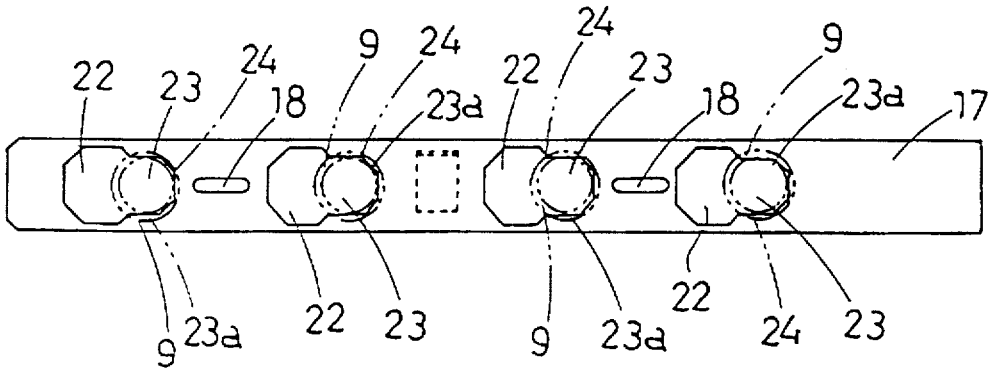
FIG. 8 is a plan view of the slide plate showing inner edges about outlet nozzle engaging holes engaged with annular recesses of corresponding outlet nozzles.
Figure 9:
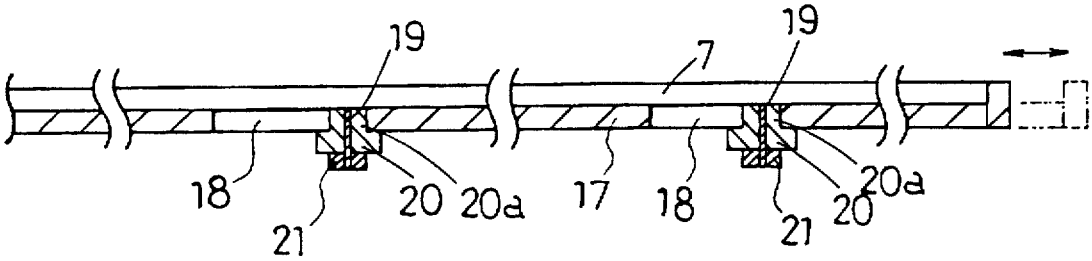
FIG. 9 is a cross sectional explanatory view showing the slide plate in a support state.

During operation of the processing liquid cartridge storage apparatus 4a, upon the outlet nozzles 9 being inserted into the apertures 8 of the cartridge bed plate 7 and the outlet nozzle holes 22 of the slide plate 17 (through the guide members 15), they are fastened to the cartridge bed plate 7 by the slide plate 17 sliding from a home location shown in FIG. 7 to a leftward location shown in FIG. 8 so that inner edges 23a of the outlet nozzle holding holes 23 engage with annular recesses 24 (FIG. 5) provided in the outer surfaces of the outlet nozzles 9.

Embodiment 2

The components denoted by 1 to 10 are identical to those of Embodiment 1 and will not be explained in further detail.

Figure 10:
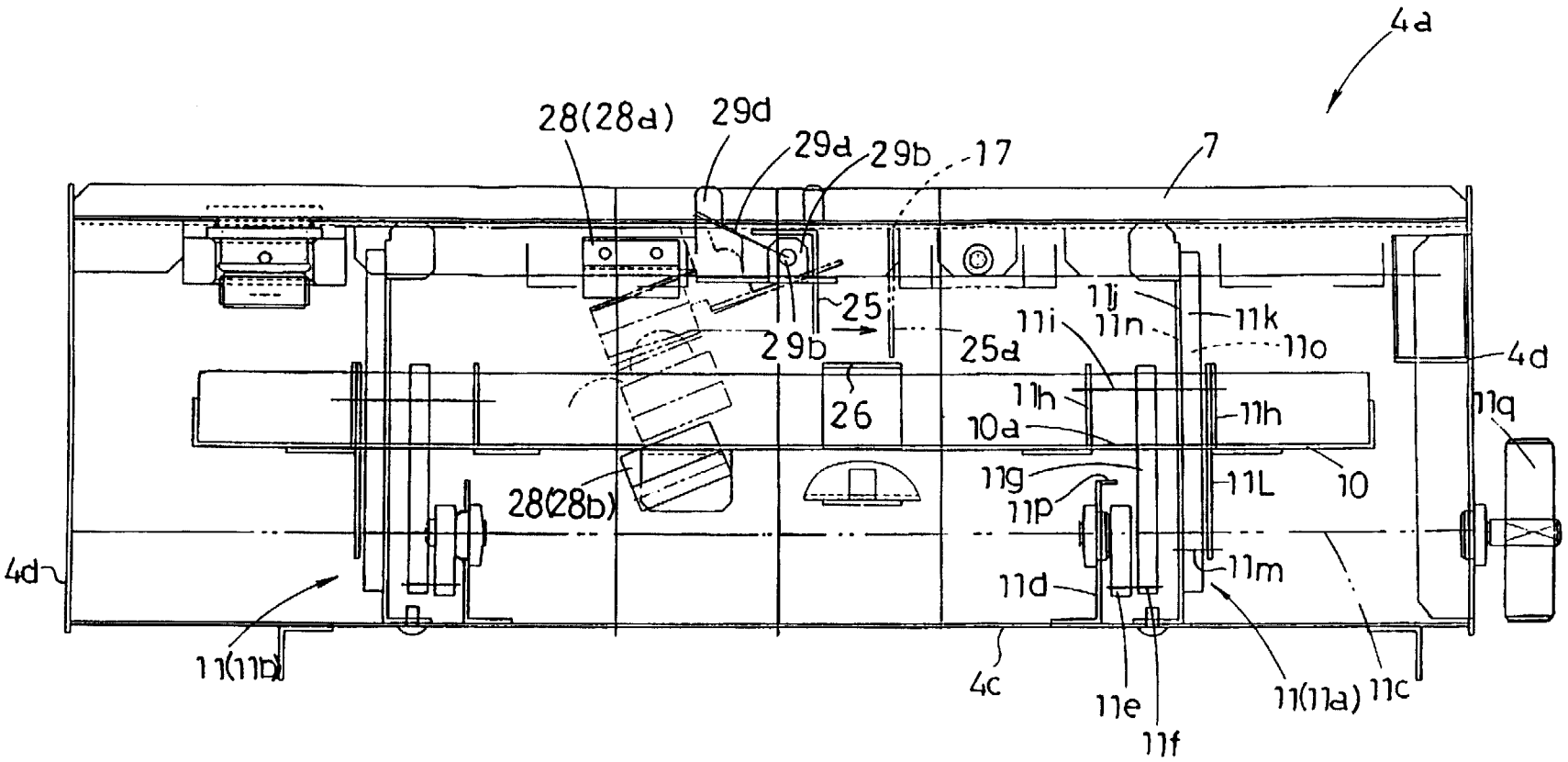
FIG. 10 is a schematic front view of a processing liquid cartridge.

FIG. 10 illustrates a right lifting means 11a, a left lifting means 11b, and an operating handle shaft 11c. The right and left, lifting means 11a and 11b are located near respective opposite ends of the support member 10, and the following description will be related to the right lifting means 11a.

The right lifting means 11a comprises a support bracket lid fixedly mounted on a bottom plate 4c of the processing liquid cartridge storage apparatus 4a. A link rod lie is rotatably mounted by the operating handle shaft 11c to the support bracket 11d. A support member lifting rod 11g is pivotably mounted at its lower end by a link pin 11f to a lower end of the link rod 11e. A pair of brackets 11h are fixedly mounted to the support member 10 at opposite sides of an opening 10a therein. A support pin 11i pivotably joins the support member lifting rod 11g to the brackets 11h. A vertical bracket 11j is disposed across the opening 10a of the support member 10 to join the cartridge bed plate 7 and the bottom plate 4c to each other. A guide bracket 11k is fixedly mounted to the vertical bracket 11j lengthwisely thereof. A support bracket 11L is fixedly mounted to the inner side of one of the paired brackets 11h so as to extend in parallel with the guide bracket 11k. A pin 11m is fixedly mounted at one end thereof to a lower end of the support bracket 11L and has another end extending across slots provided in the guide bracket 11k and the vertical bracket 11j, which slots are described below, to a retainer (not shown) so that the support bracket 11L with the pin 11m moves upward and downward. The slots provided in the vertical bracket 11j and the guide bracket 11k are denoted at 11n and 11o, respectively, and the support pin 11i moves upward and downward therealong. A stopper 11p is formed integral with the upper end of the support bracket 11d for limiting the angle of rotational movement of the link rod 11e. The operating handle shaft 11c is rotatably mounted between opposite side plates 4d of the processing liquid cartridge storage apparatus 4a and extends across the support brackets 11d, the vertical brackets, 11j, and the guide brackets 11k of the two lifting means 11a and 11b. The link rods 11e are fixedly joined at their proximal end to the operating handle shaft 11c. An operating handle 11a is fixedly mounted to one end of the operating handle 11c.

Figure 11:
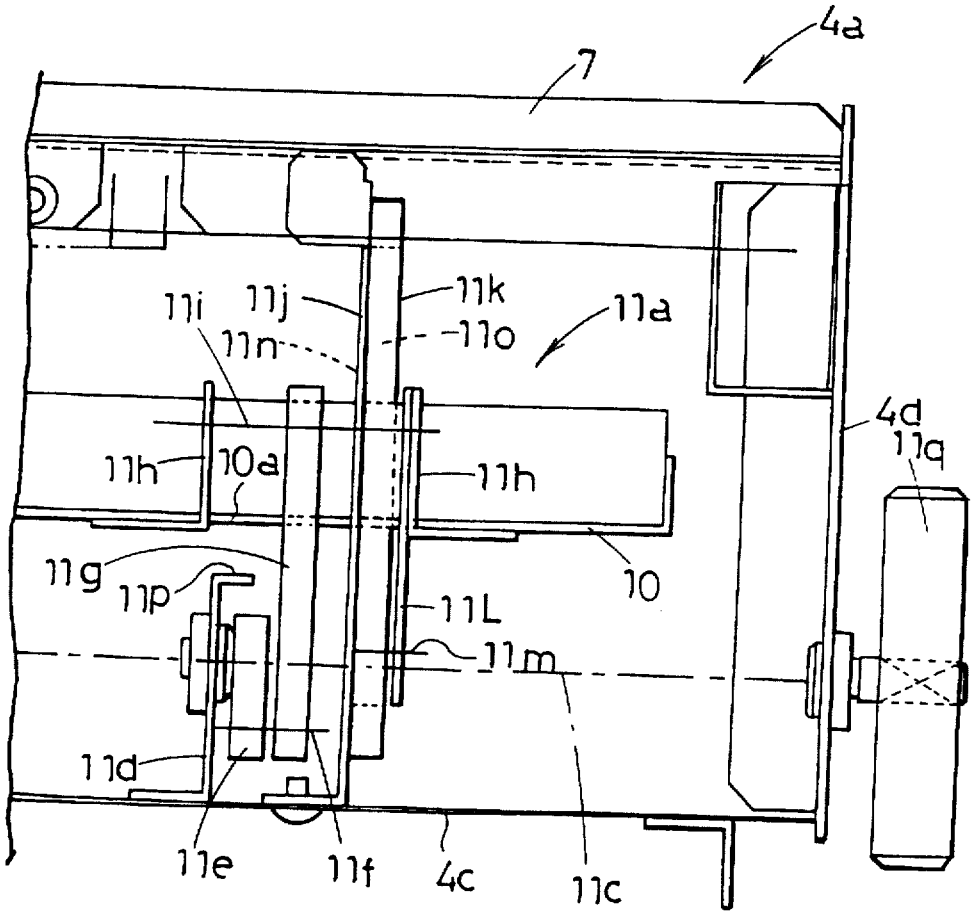
FIG. 11 is an explanatory view of a lifting means with a support member being moved down.
Figure 12:
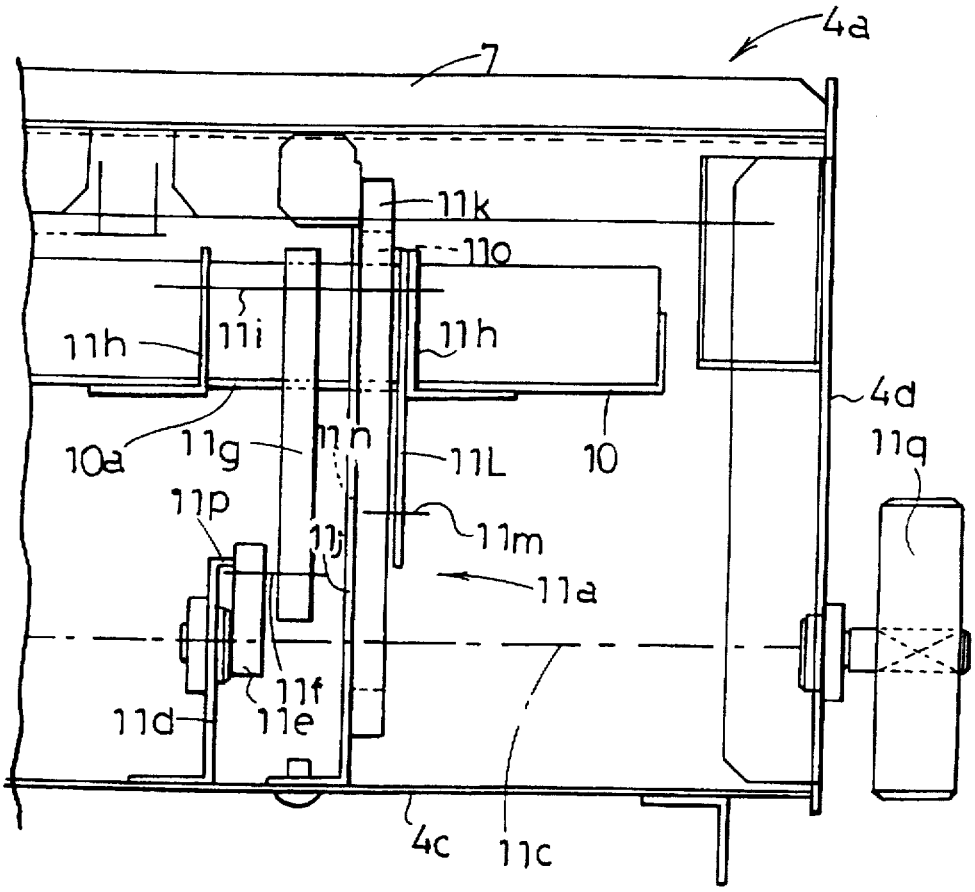
FIG. 12 is an explanatory view of the lifting means with support member being lifted up.

FIG. 11 shows the lifting means 11a locating the support member 10 at a lower position or in a central region of the processing liquid cartridge storage apparatus 4a. When the operating handle 11q is operated, the link rod 11e turns until its distal end comes into direct contact with the stopper 11p on the support bracket 11d, as shown in FIG. 12. Simultaneously, the support member lifting rod 11g linked by the link pin 11f to the link rod 11e is lifted up while swinging forward and backward. Accordingly, the support pin 11i allows the paired brackets 11h and thus the support member 10 to move upwards close to the cartridge bed plate 7. The support member 10 can be moved down to its home position shown in FIG. 11 by turning the operating handle 11q in a reverse direction.

Figure 13:
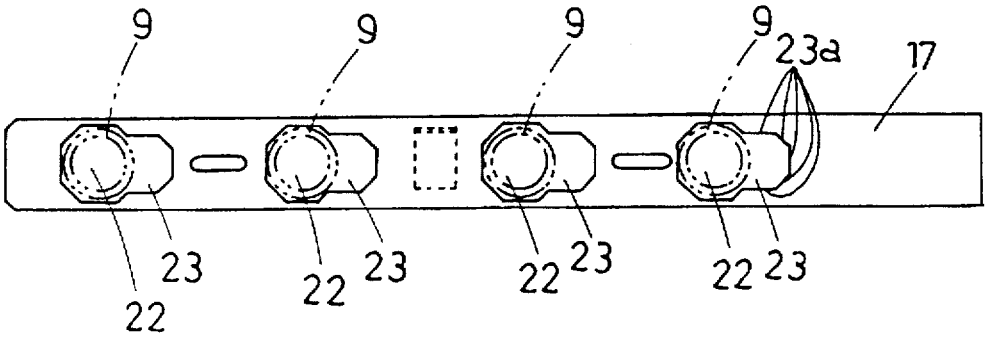
FIG. 13 is a plan view of the slide plate.
Figure 14:
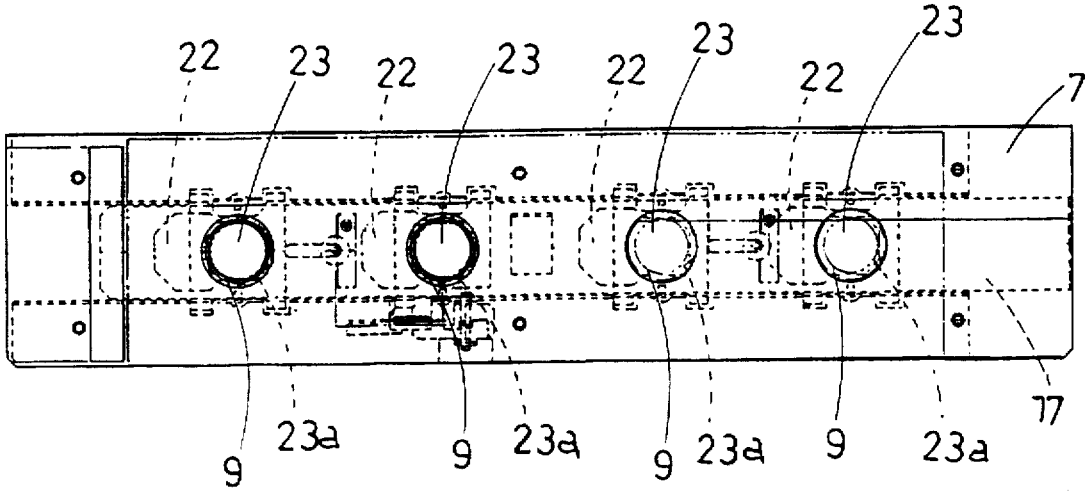
FIG. 14 is a plan view of a processing liquid cartridge storage apparatus.

As described previously, the support member 10 (FIG. 4) is provided with the delivery nozzles 12 for different processing liquids aligning with the corresponding apertures 8 in the cartridge bed plate 7 and connecting to their respective conduits 13. Also, the guide member 15 (FIG. 4) is fixedly mounted by the retainer member 16 to the lower surface of the cartridge bed plate 7 below each aperture 8 for guiding the corresponding output nozzle 9 of the processing liquid cartridge 5 (FIG. 5) so that it is spaced by a few millimeters from the cartridge bed plate 7. The slide plate 17 shown in FIGS. 13 and 14 is slidably interposed between the cartridge bed plate 7 and the guide members 15. The slide plate 17 has four outlet nozzle holes 22 provided therein at equal intervals for holding at once the outlet nozzles 9 of the processing liquid cartridge 5 extending through the corresponding apertures 8 of the cartridge bed plate 7, each outlet nozzle hole 22 communicating with an outlet nozzle holding hole 23 thus to form a hole pair. Upon the outlet nozzles 9 being inserted into the corresponding apertures 8 of the cartridge bed plate 7 and the outlet nozzle holes 22 of the slide plate 17 (through the guide members 15), they are fastened at once to the cartridge bed plate 7 by sliding the slide plate 17 so that the annular recesses 24 of the outlet nozzles 9 (FIG. 5) are engaged with the inner edges 23*a* of the slide plate 17 at the outlet nozzle holding holes 23.

Accordingly in the processing liquid cartridge storage apparatus 4*a* of this embodiment, when the processing liquid cartridge 5 (FIG. 3) is loaded in position onto the cartridge bed plate 7, its outlet nozzles 9 pass through the apertures 8 of the cartridge bed plate 7 and the outlet nozzle holes 22 of the slide plate 17 and enter not shown outlet nozzle holes of the guide members 15. Then, the slide plate 17 is pressed by hand as shown in FIG. 14 until the inner edges 23*a* of the outlet nozzle holding holes 23 engage with and hold the corresponding outlet nozzles 9. This is followed by turning the operating handle 11*q* to cause the lifting means 11 (11*a* and 11*b*) to lift up the support member 10 to the predetermined level shown in FIG. 4. As a result, the delivery nozzles 12 on the support member 10 are joined at once to the corresponding outlet nozzles 9 of the processing liquid cartridge 5 held in the outlet nozzle holes (not shown) of the guide members 15. For separating the outlet nozzles 9 from the delivery nozzles 12, the operating handle 11*q* is turned in a reverse direction to actuate the lifting means 11 which in turn moves down the support member 10. Accordingly, the outlet nozzles 9 readily depart from the corresponding delivery nozzles 12.

A processing liquid cartridge storage apparatus 4 in an automatic development processor machine shown in FIGS. 15 to 23 allows the support member 10 provided with the delivery nozzles 12 for processing liquids to be fixedly located in the interior thereof. In particular, the cartridge bed plate 7 on which the processing liquid cartridge 5 (6) (FIG. 16) is loaded is arranged to be movable upward and downward by the action of a lifting mechanism 30. The other components and their arrangement, other than the lifting mechanism 30, are substantially identical to those of the previous embodiment and will not be explained in further detail.

The lifting mechanism 30 comprises lifting plates 30*a* (FIGS. 16 and 21) fixedly joined at tops thereof to the lower surface of the cartridge bed plate 7 and extending along the inner sides of a front panel 4*d* and a rear panel 4*e* of the processing liquid cartridge storage apparatus. Guide members 30*c* having vertical slots 30*b* provided therein (FIGS. 18 and 19) are adjacent to both ends of the front and rear panels 4*d* and 4*e*. Link pins 30*d* are engaged in corresponding slots 30*b* for vertical movement. A pair of left and right swing links 30*e* of a U or L shape are joined to one end of each link pin 30*d*, the other end of which is joined to the front 4*d* and rear 4*e* panels. Guide members 30*g* have horizontal slots 30*f* provided therein and are located beneath the guide members 30*c* on the front and rear panels 4*d* and 4*e*. Engaging pins 30*h* are mounted at one end thereof to lower regions of the swing links 30*e* for movement along and in the horizontal slots 30*f* of the guide members 30*g*. Link members 30*i* are joined to the other ends of the engaging pins 30*h*. Link rods 30*j* are pivotably to the link members 30*i*. A pivot shaft 30*k* is fixedly joined at opposite ends thereof to the respective two link rods 30*j*. A round handle 30L (30*m*) is fixedly mounted to one outward end of the pivot shaft 30*k* extending through the front panel 4*d*. The pivot shaft 30*k* is rotatably mounted between the front panel 4*d* and the rear panel 4*e*.

Figure 22:
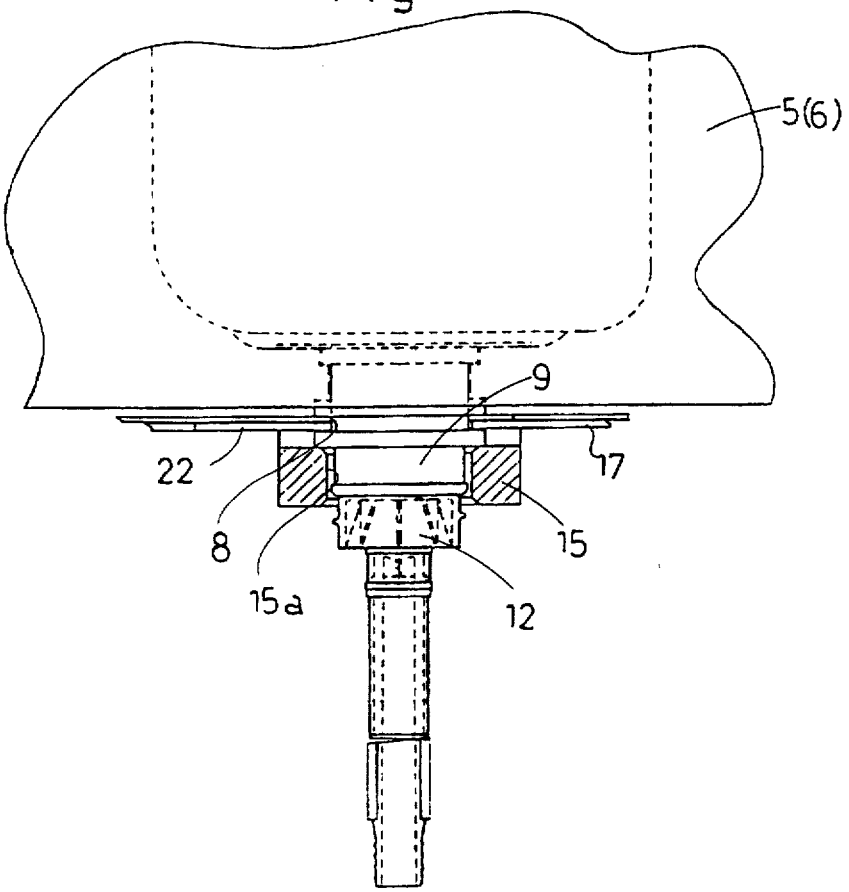
FIG. 22 is an explanatory view of nozzles and with a support member being moved down.
Figure 23:
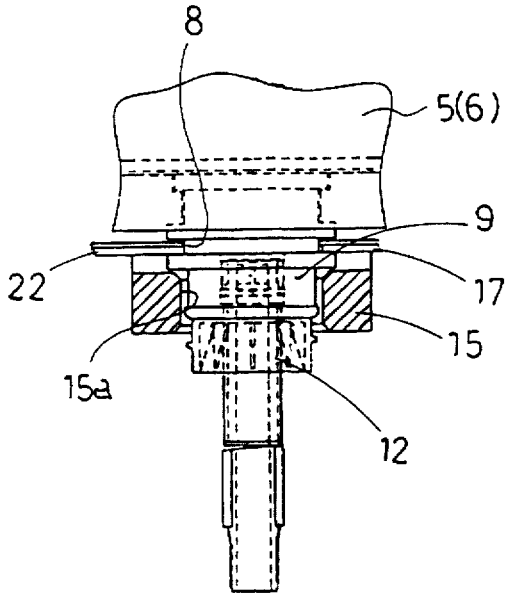
FIG. 23 is an explanatory view of the nozzles and with the support member being lifted up.

In operation, the lifting mechanism 30 is actuated when the processing liquid cartridge 5 (6) has been loaded in position onto the cartridge bed plate 7 with outlet nozzles 9 inserted into the apertures 8 of the cartridge bed plate 7, outlet nozzle holes 22 of the slide plate 17, and outlet nozzle holes 15*a* of the guide members 15, followed by sliding the slide plate 17 to hold the outlet nozzles 9. More specifically, the turning of the round handle 30L (30*m*) causes the link bars 30*j*, the link pins 30*h*, the guide members 30*g*, the swing links 30*e*, the link pins 30*d*, the guide members 30*c* and the lifting plates 30*a* in this order to actuate as shown by the imaginary lines. Accordingly, the cartridge bed plate 7 linked by the lifting plates 30*a* to the link pins 30*d* is lowered, allowing outlet nozzles 9 to connect with the corresponding delivery nozzles 12 on the support member 10 (FIG. 23). Reverse turning of the round handle 30L causes the lifting mechanism 30 to lift up the cartridge bed plate 7, thus separating at once the outlet nozzles 9 of the cartridge bed plate 7 from the delivery nozzles 12 on the support member 10 (FIG. 22). This allows the processing liquid cartridge 5 (6) when exhausted to be replaced by a new processing liquid cartridge filled with a processing liquid without delay.

Embodiment 3

An automatic development processor machine 1 and processing liquid cartridge storage apparatuses 4*a* and 4*b* are substantially identical in construction to those described previously and will not be explained in further detail.

Figure 24:
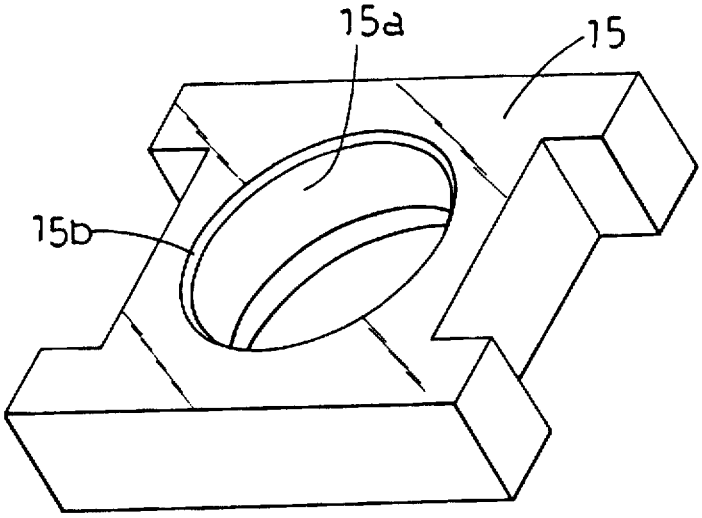
FIG. 24 is a perspective view of a guide member.
Figure 25:
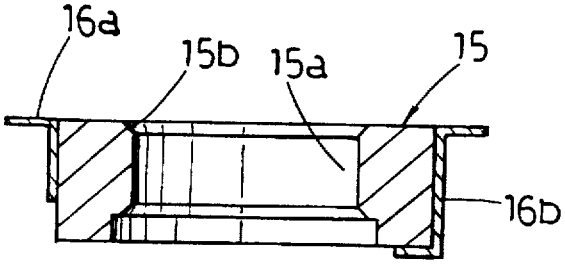
FIG. 25 is a cross sectional view of the guide member with retainer members.

The guide member 15 in this embodiment is made of a hard type synthetic resin material as shown in FIG. 24 and 25, and has a outlet nozzle holding hole 15*a* provided in the center thereof. A bevel 15*b* is formed about the outlet nozzle holding hole 15*a* of the guide member 15. A group of the guide members 15 are mounted by the retainer members 16 to the lower surface of the cartridge bed plate 7 as shown in FIG. 4. More particularly, each guide member 15 is placed with its bevel 15*b* facing upwardly and its holding hole 15*a* aligned with the corresponding aperture 8 of the cartridge bed plate 7 and is fastened to the lower surface of the cartridge bed plate 7 at one side by an L shaped retainer 16*a* anchored by a screw(s) and at the other side by a hook retainer 16*b* which supports the bottom of the guide member 15, as shown in FIG. 25. The guide member 15 is also spaced by a few millimeters from the lower surface of the cartridge bed plate 7.

Figure 26:
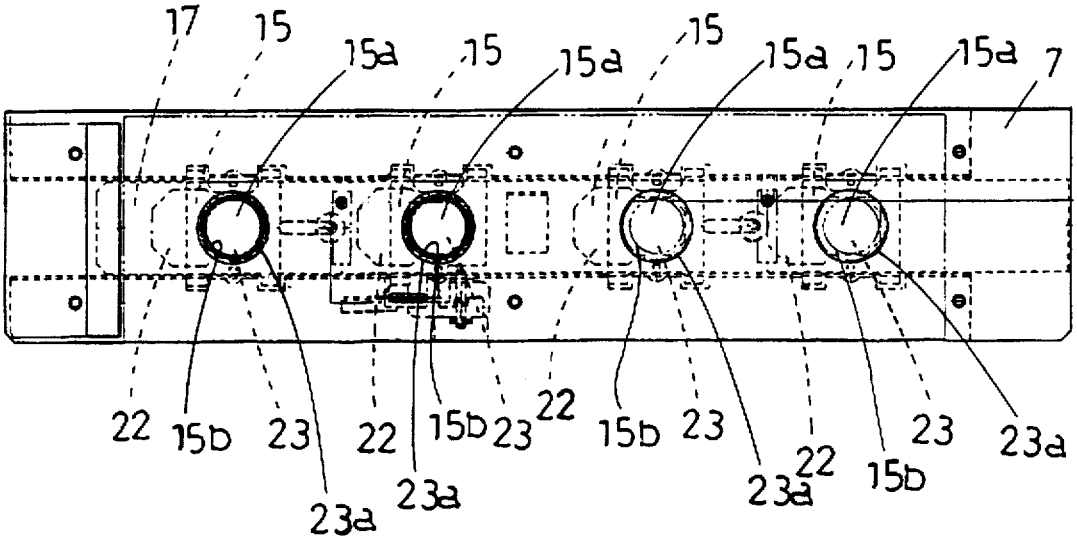
FIG. 26 is a plan view of a processing liquid cartridge storage apparatus.

Slide plates 17 is movably interposed between the cartridge bed plate 7 and the guide members 15, as shown in FIG. 26. The slide plate 17 has the four outlet nozzle holes 22 provided therein at equal intervals for holding at once the outlet nozzles 9 of the processing liquid cartridge 5 (FIG. 5) extending through the corresponding apertures 8 of the cartridge bed plate 7. Each outlet nozzle hole 22 communicates with an outlet nozzle holding hole 23 to thus form a hole pair. Upon the outlet nozzles 9 being inserted into the corresponding apertures 8 of the cartridge bed plate 7 and the outlet nozzle holes 22 of the slide plate 17 (through the guide members 15), they are fastened at once to the cartridge bed plate 7 by sliding the slide plate 17 so that the annular recesses 24 of the outlet nozzles 9 are engaged with the inner edges 23*a* of the slide plate 17 at the outlet nozzle holding holes 23.

Accordingly, in the processing liquid cartridge storage apparatus 4*a* of this embodiment, when the outlet nozzles 9 are inserted into the apertures 8 of the cartridge bed plate 7, the outlet nozzle holes 22 of the slide plate 17 and the outlet nozzle holding holes 15*a* of the guide members 15, their leading ends are guided with the bevels 15*b* about the outlet nozzle holding holes 15*a* of the guide members 15, thus correcting any misalignment which may be caused during passage through the loose apertures 8 of the cartridge bed plate 7.

Embodiment 4

An automatic development processor machine 1 and processing liquid cartridge storage apparatuses 4*a* and 4*b* are substantially identical in construction to those described previously and will not be explained in further detail.

Figure 6:
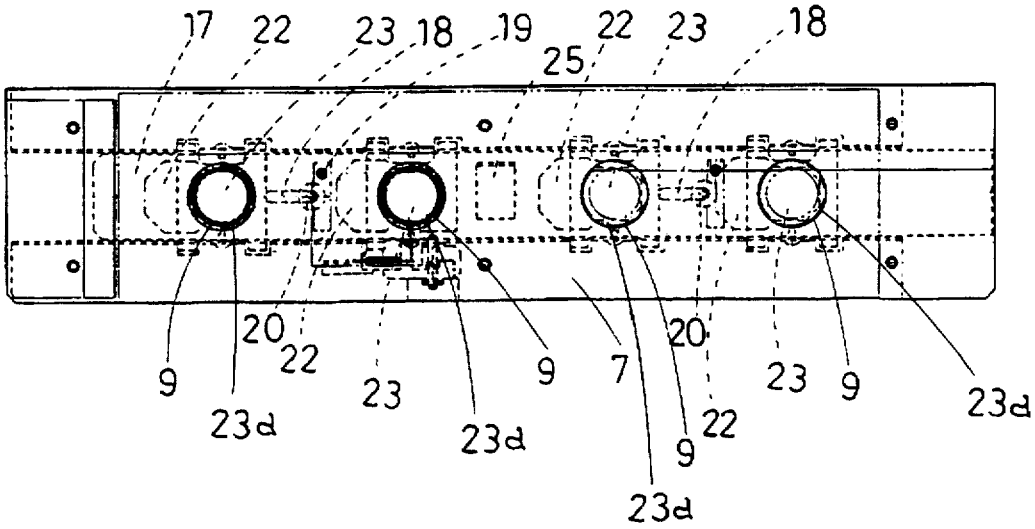
FIG. 6 is a plan view of the processing liquid cartridge storage apparatus.

As shown in FIGS. 6 to 9, the slide plate 17 is slidably interposed between the cartridge bed plate 7 and the guide members 15. The slide plate 17 is a narrow rectangular strip having two lengthwisely extending slots 18 provided therein. There are a pair of stud bolts 19 mounted upright on the lower surface of the cartridge bed plate 7 and accepted in the two slots 18 of the slide plate 17 respectively. Each stud bolt 19 is provided with a collar 20 having a radially reduced region 20*a* which is sized so that it moves along and in the slot 18. A retainer nut 21 is screwed onto the distal end of bolt 19 to hold the collar 20. The slide plate 17 is supported so that it slides beneath and along the lower surface of the cartridge bed plate 7. The slide plate 17 has four outlet nozzle holes 22 provided therein at equal intervals for holding at once the outlet nozzles 9 of the processing liquid cartridge 5 extending through the corresponding apertures 8 of the cartridge bed plate 7 (FIG. 2). Each outlet nozzle hole 22 communicates with an outlet nozzle holding hole 23, thus to form a connected hole pair. Upon the outlet nozzles 9 being inserted into the corresponding apertures 8 of the cartridge bed plate 7 and the outlet nozzle holes 22 of the slide plate 17 (through the guide members 15), they are fastened at once to the cartridge bed plate 7 by sliding the slide plate 17 so that the annular recesses 24 of the outlet nozzles 9 (FIG. 5) are engaged with the inner edges 23*a* of the slide plate 17 at the outlet nozzle holding holes 23 (FIGS. 6 and 7).

In particular, the slide plate 17 has a contact tab 25 perpendicularly mounted to substantially a center region of the lower surface thereof as shown in FIGS. 6 and 7. When the slide plate 17 is moved outwardly so that the outlet nozzles holes 22 of the slide plate 17 are aligned with the apertures 8 of the cartridge bed plate 7, the contact tab 25 travels to a location 25*a* in the direction of an arrow shown in FIG. 10. Also, a horizontal stopper member 26 (FIG. 10) is mounted on the support plate 10 so that while the outlet nozzles 9 of the processing liquid cartridge 5 (6) loaded on the cartridge bed plate 7 are disengaged from the inner edges 23*a* of the slide plate 17 at the outlet nozzle holding holes 23 (FIG. 7), the support member 10 is disabled from moving upward with stopper member 26 interrupted by the contact tab 25 at the location 25*a*.

When the slide plate 17 is moved inwardly allowing inner edges 23*a* at the outlet nozzle holding holes 23 to hold the corresponding outlet nozzles 9 of the processing liquid cartridge 5 (6), the contact tab 25 departs from the stopper member 26 of the support plate 10 and moves back in a reverse direction shown in FIG. 10 to an original position, thus allowing the support plate 10 to be lifted up by the operation of the lifting means 11. In other words, the outlet nozzles 9 of the processing liquid cartridge 5 (6) are not connectable to the delivery nozzles 12 on the support plate 10 when they are placed on the cartridge bed plate 7 but not correctly held by the slide plate 17.

As shown in FIG. 10, there is provided a sensor means 28 which comprises a small magnet 28*a* on the cartridge bed plate 7 and a magnetic sensor 28*b* on the support member 10. More specifically, the small magnet 28*a* is mounted to a swing plate 29*a* located on the cartridge bed plate 7. The swing plate 29*a* is pivotably mounted at one end by a pivot 29*c* to a support bracket 29*b* anchored to the lower surface of the cartridge bed plate 7 and is generally urged by a spring (not shown) against the lower surface of the cartridge bed plate 7. The swing plate 29*a* is joined to a pressing rod 29*d* which extends upwardly through an opening of the cartridge bed plate 7.

When the processing liquid cartridge 5 (6) is loaded onto the cartridge bed plate 7 as shown in FIG. 3, it presses down the pressing rod 29*d* which in turn lowers the swing plate 29*a*. As the swing plate 29*a* is lowered about the pivot 29*c*, the small magnet 28*a* moves down diagonally. The small magnet 28*a* at the lower position is then detected by the magnetic sensor 28*b* on the support member 10 which is lifted up. The detection by the magnetic sensor 28*b* is indicative of the delivery nozzles 12 of the support member 10 being joined to the corresponding outlet nozzles 9 of the processing liquid cartridge 5 (6), and an electric signal from sensor 28 allows the automatic development processor machine 1 to be set in an enable state. The sensor means 28 may be composed of a limit switch or any detecting device.

Figure 15:
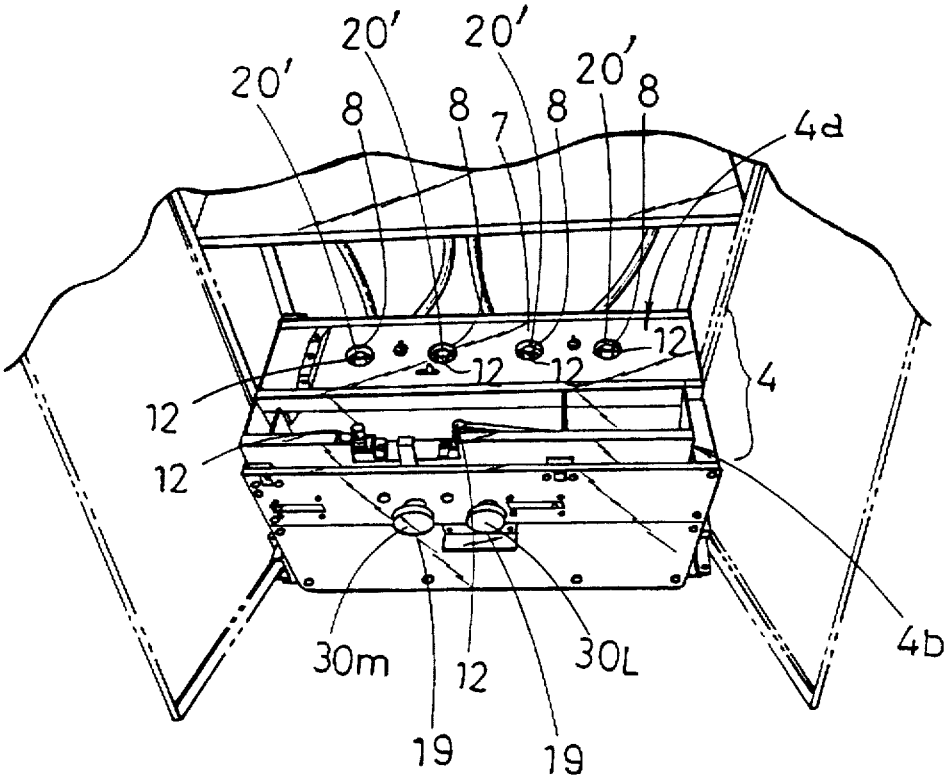
FIG. 15 is a perspective view of a processing liquid cartridge storage with its cartridge bed plate removed in another automatic development processing system.
Figure 16:
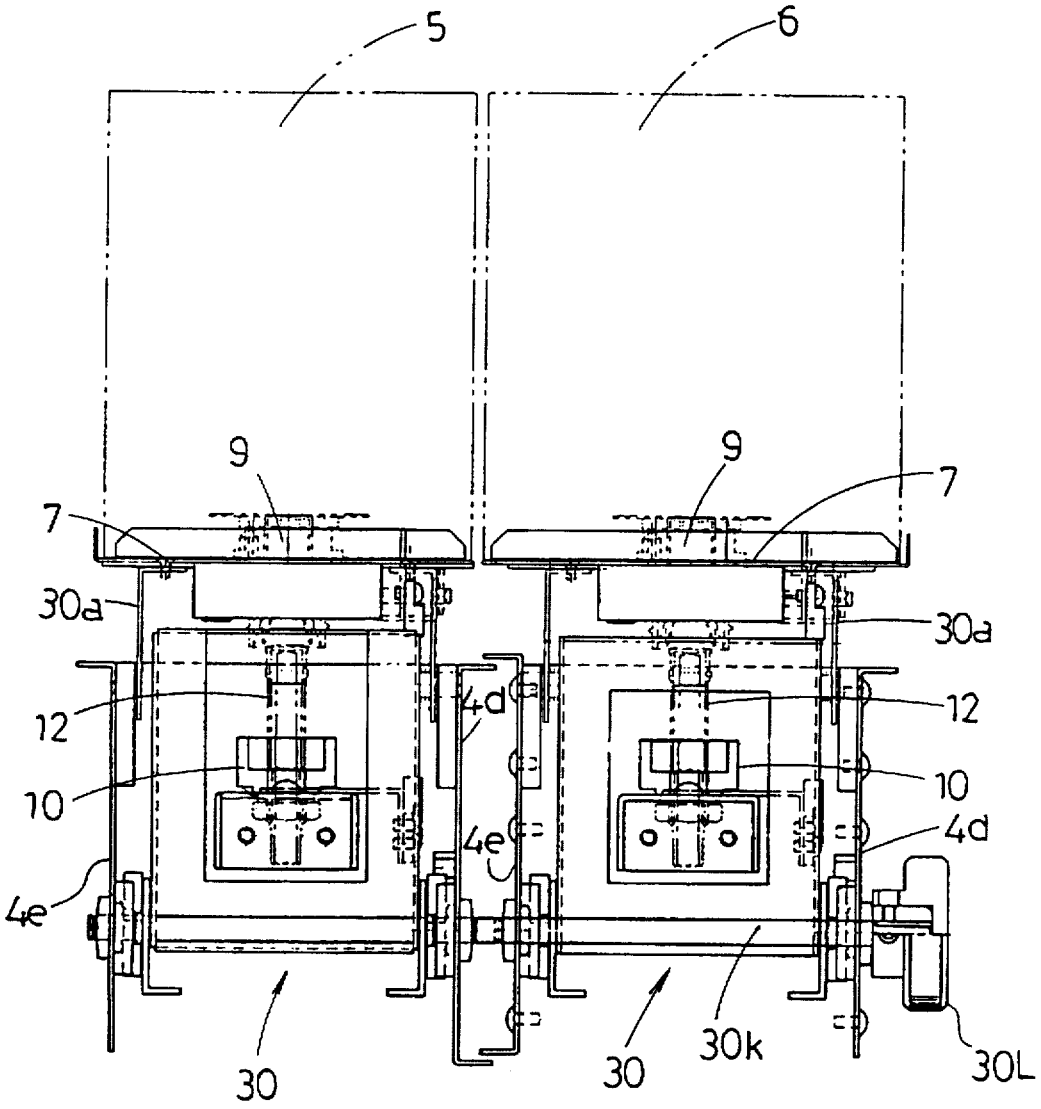
FIG. 16 is a side view of the processing liquid cartridge storage apparatus of FIG. 15.
Figure 17:
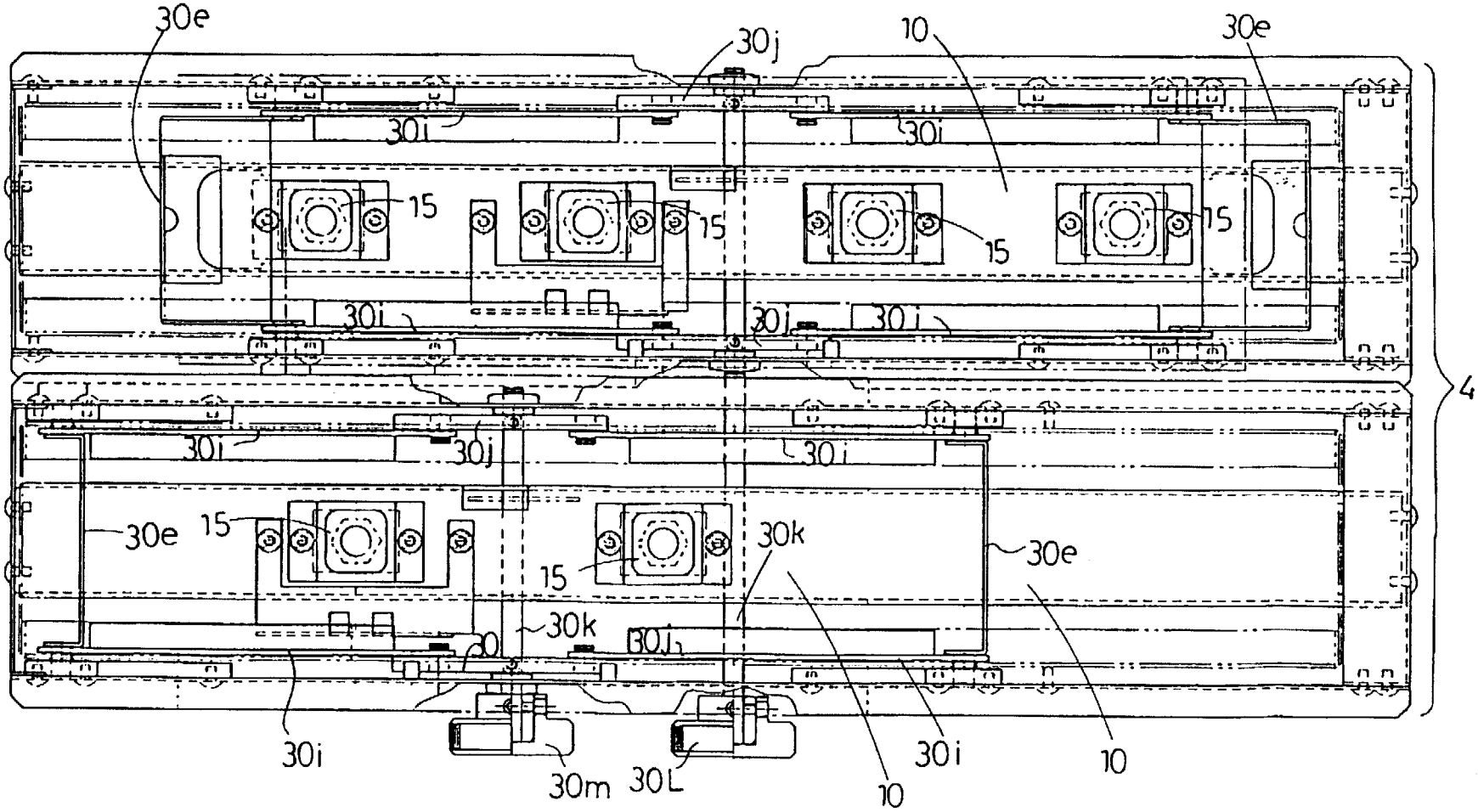
FIG. 17 is a plan view of the processing liquid cartridge storage apparatus of FIG. 15.
Figure 18:
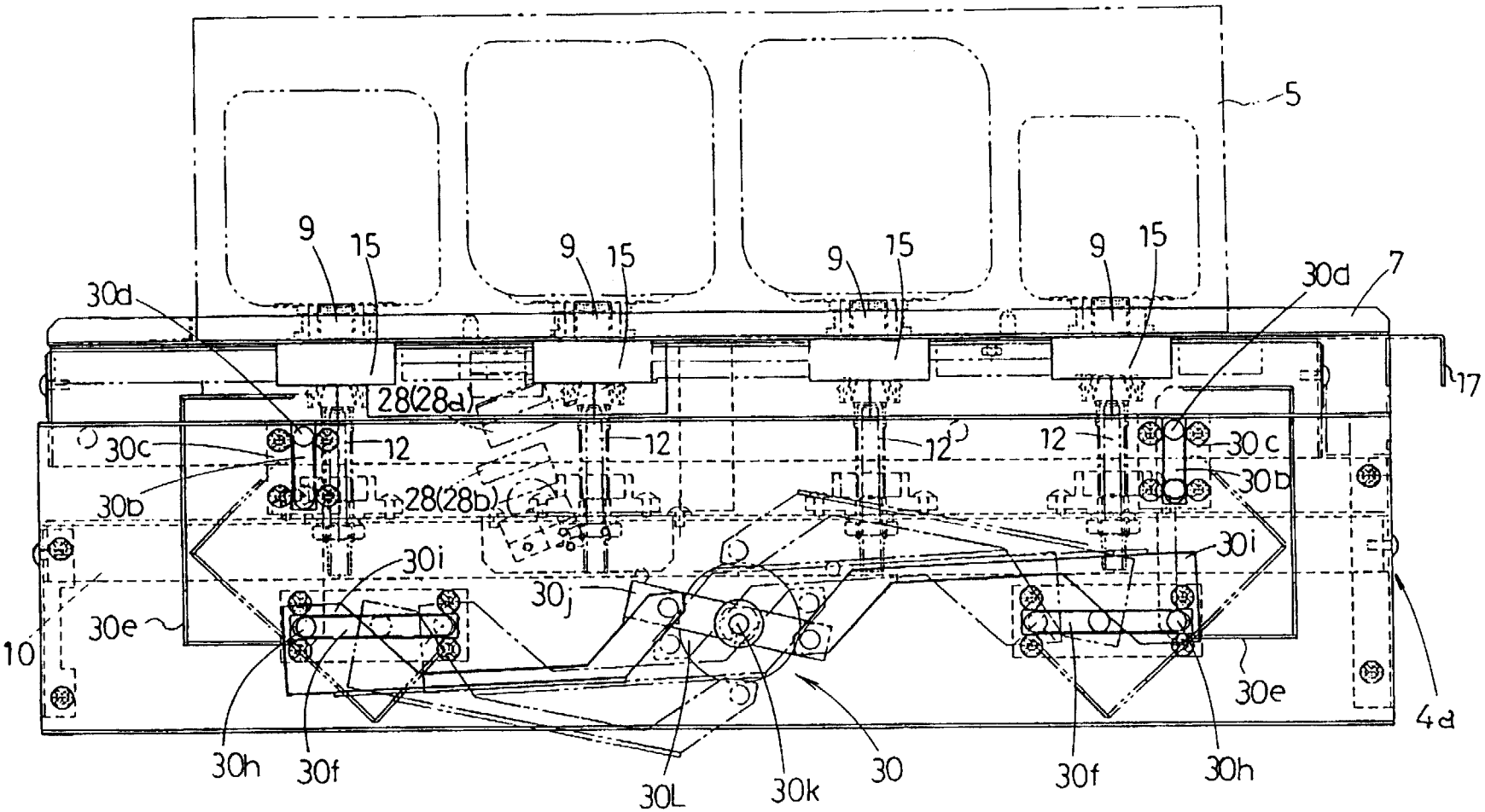
FIG. 18 is a front view of a processing liquid cartridge storage apparatus of FIG. 15.
Figure 19:
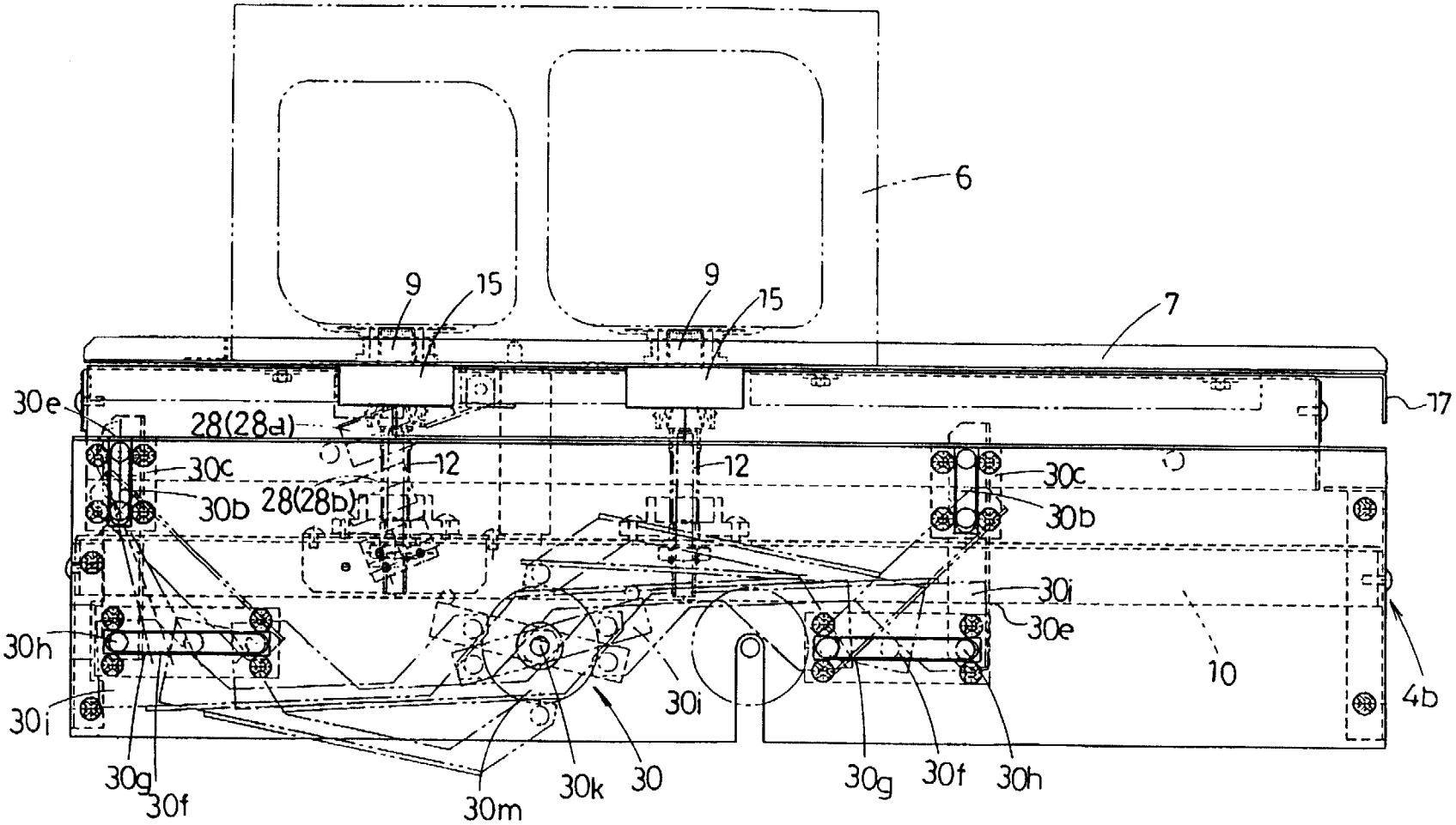
FIG. 19 is a front view of a processing liquid cartridge storage apparatus of FIG. 15.
Figure 20:
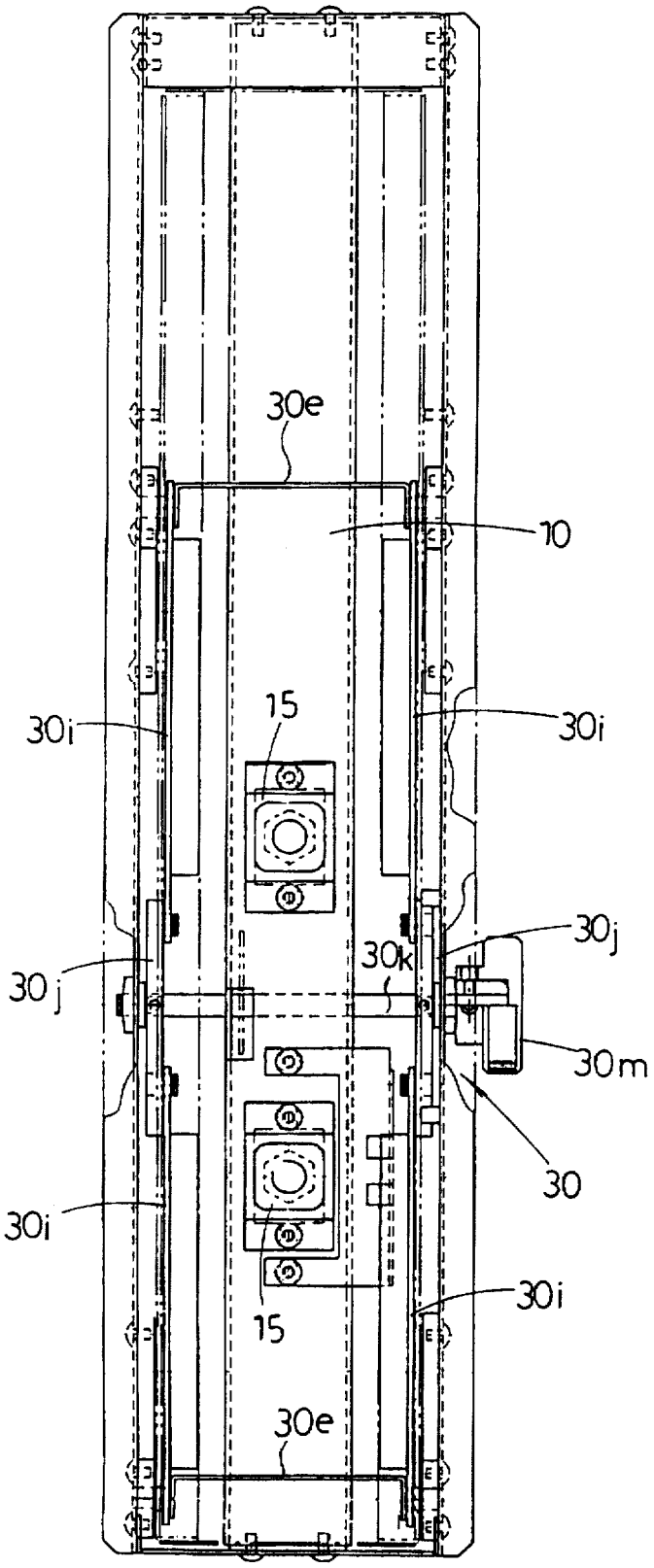
FIG. 20 is a plan view of the processing liquid cartridge storage apparatus of FIG. 15.
Figure 21:
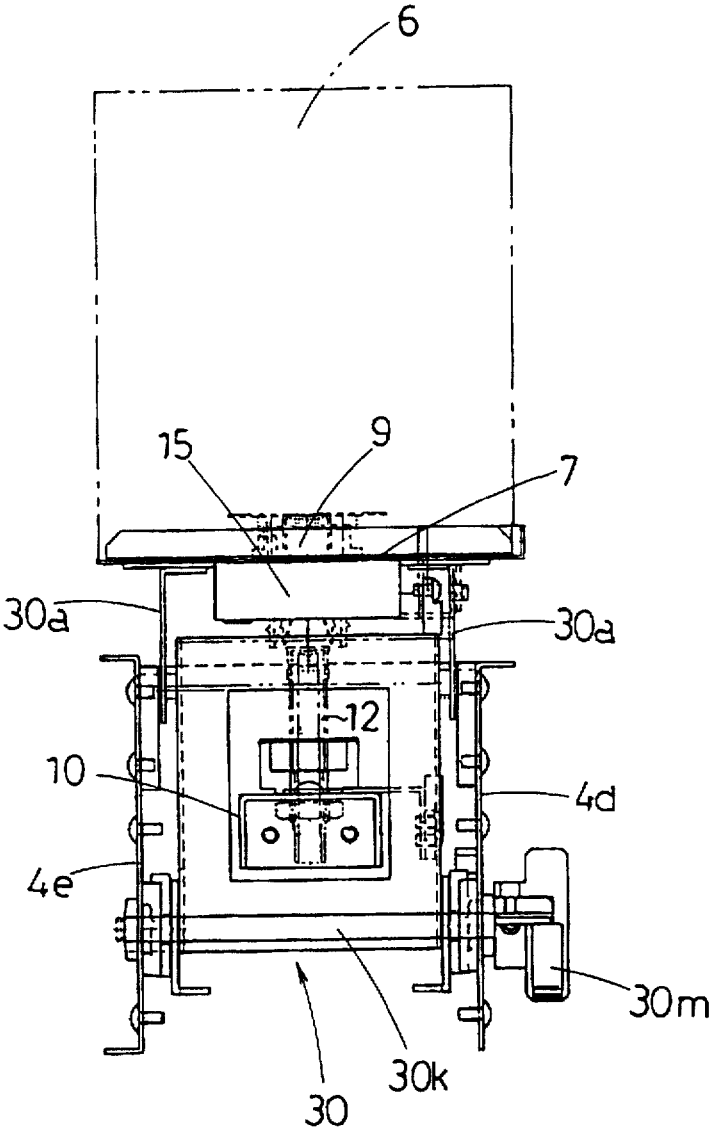
FIG. 21 is a side view of the processing liquid cartridge storage apparatus of FIG. 15.

As shown in FIGS. 15, 18, and 19, the processing liquid cartridge storage apparatus 4*a* (4*b*) in the automatic development processor machine allows the lifting means 30 to move up and down the cartridge bed plate 7 relative to the support member 10 which carries the delivery nozzles 12 and which remains stationary in the apparatus 4*a* (4*b*).

The contact tab, the stop member (not shown), and the sensor means 28 (28*a* and 28*b*) are provided as well as the other components in this embodiment and their operations and effects are identical to those of the above embodiment.

Embodiment 5

Embodiment 5 of the present invention will now be described in which an automatic development processor machine 1 and processing liquid cartridge storage apparatuses 4*a* and 4*b* are substantially identical in the construction to those of the previous embodiments.

Figure 27:
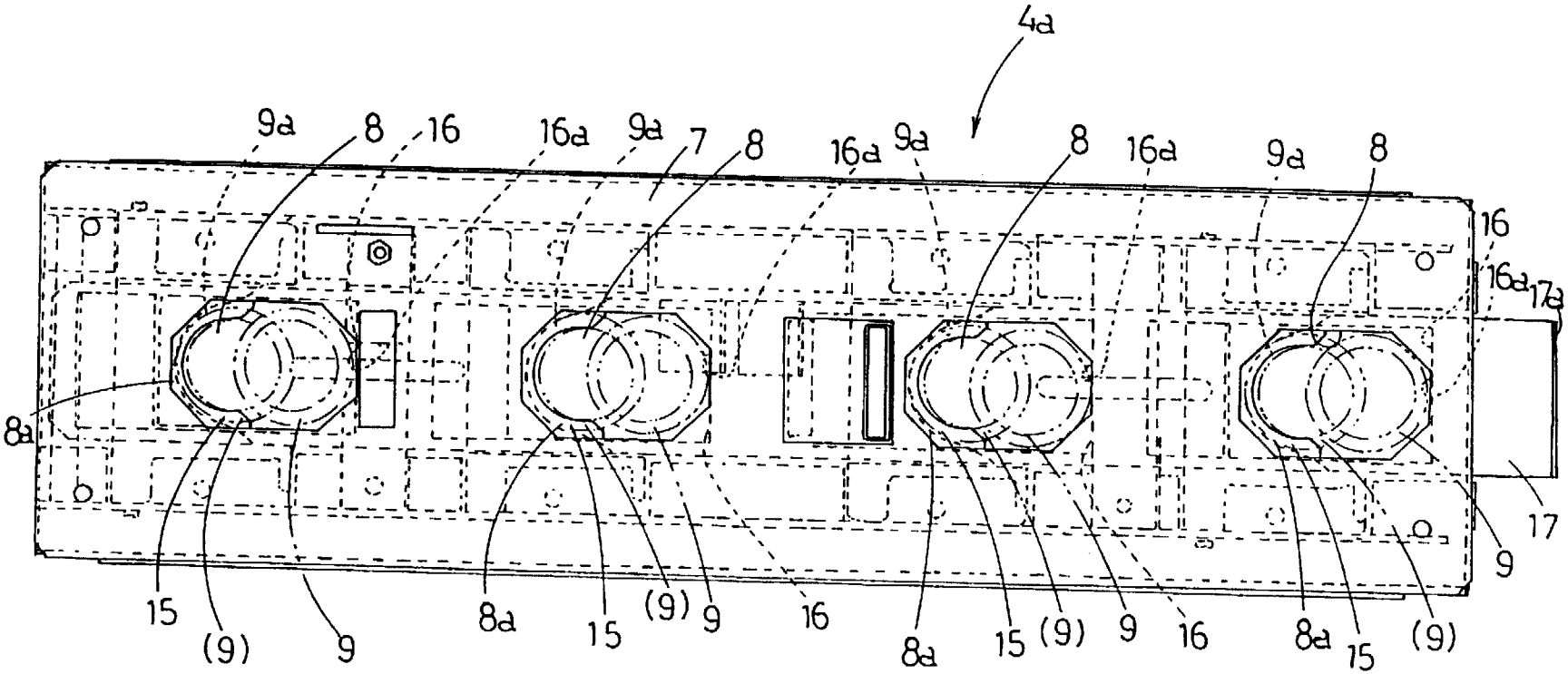
FIG. 27 is a plan view showing a part of the processing liquid cartridge storage apparatus.
Figure 28:
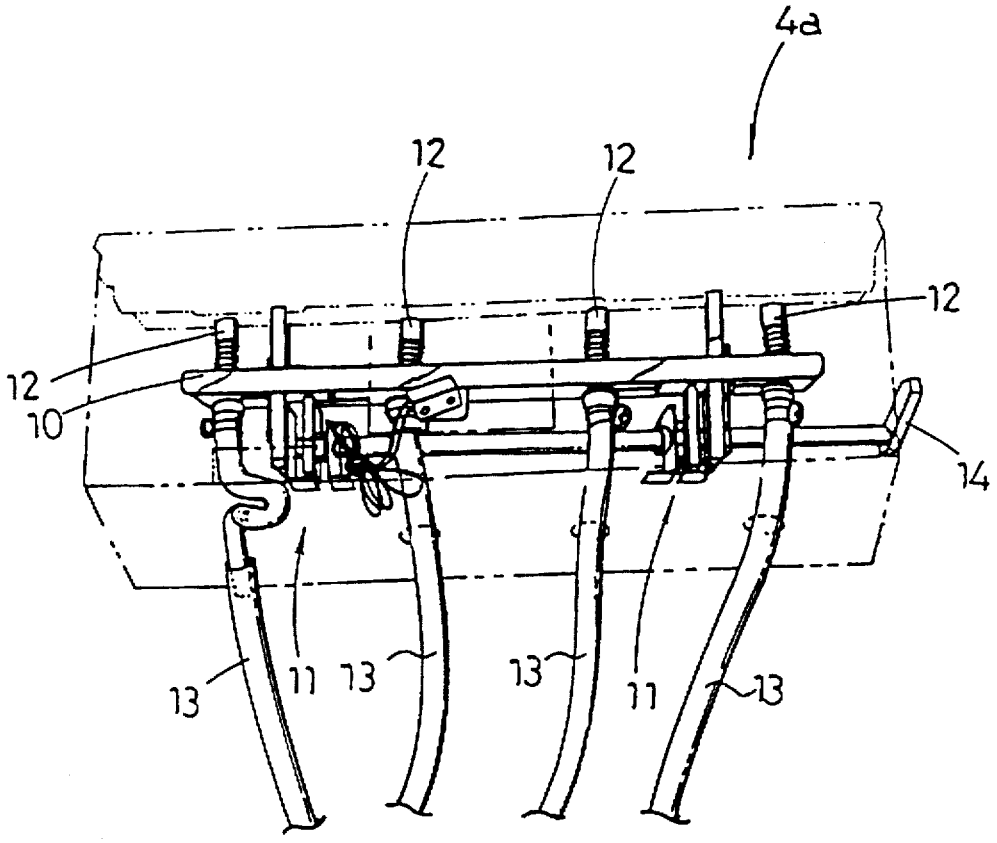
FIG. 28 is a perspective view of an interior of the processing liquid cartridge storage apparatus.
Figure 29:
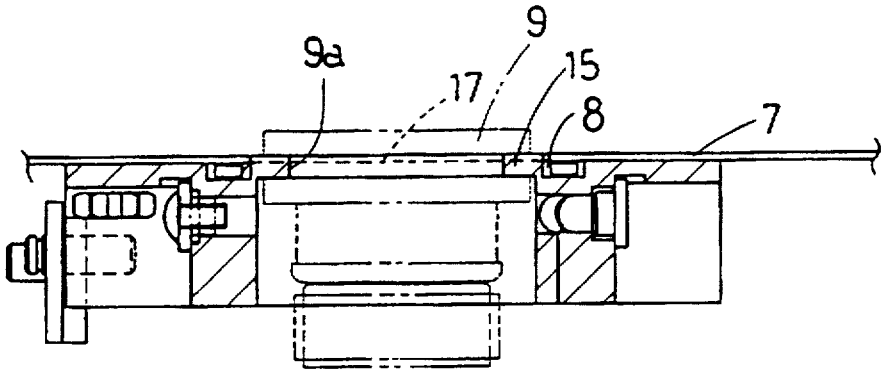
FIG. 29 is a cross sectional view of a primary part defined in Embodiment 5 of the present invention.
Figure 30:
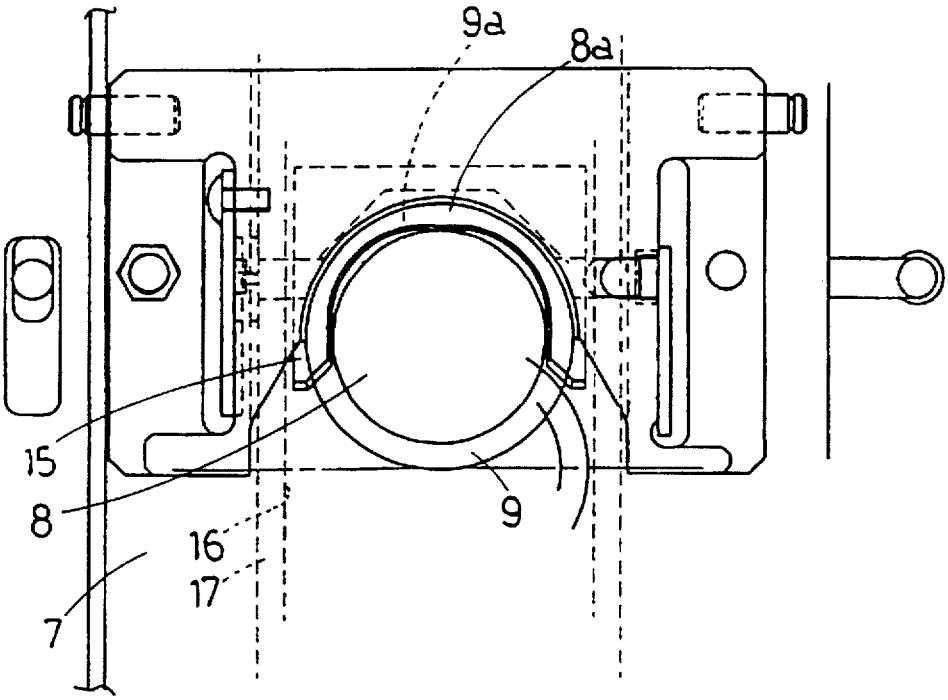
FIG. 30 is a plan view of the primary part defined in Embodiment 5 of the present invention.

As shown in FIGS. 27, 29, and 30, a guide or fitting member 15 having a horse-shoe shape and a thickness of about 2.9 mm is mounted to a half-circular edge 8*a* about each aperture 8 of the lower surface of the cartridge bed plate 7 for detachable engagement with annular recess 9*a* (about 3 mm in depth) of the outlet nozzle 9. The horse-shoe shaped fitting member 15 engages in the annular recess 9*a* and holes the outlet nozzle 9 from three horizontal directions without looseness.

Figure 31:
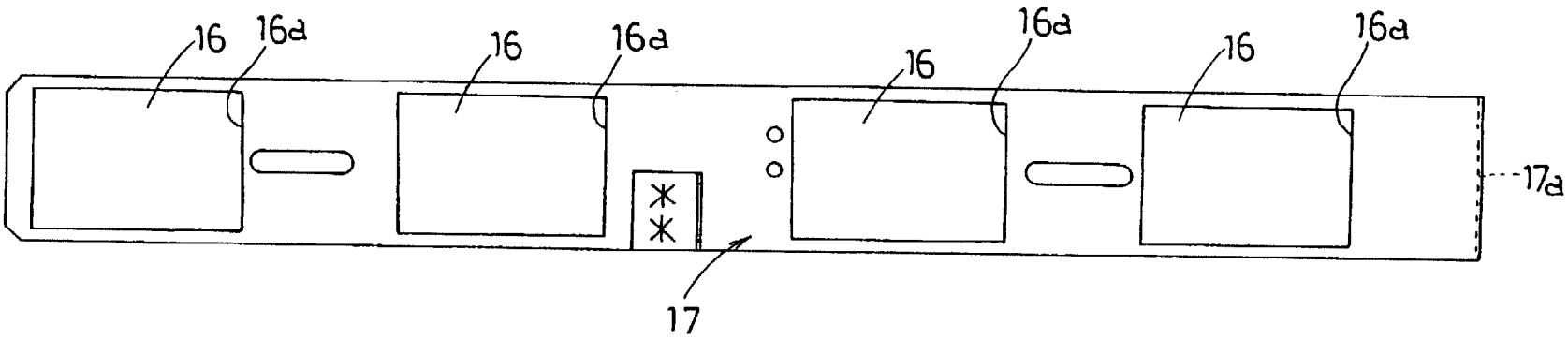
FIG. 31 is a plan view of a slide plate.

The slide plate 17 is disposed for sliding movement along the lower surface of the cartridge bed plate 7 and has four rectangular holes 16 provided therein for passing the outlet nozzles 9 of the processing liquid chambers of the processing liquid cartridge 5 loaded on the cartridge bed plate 7. More particularly, the slide plate 17 is a narrow rectangular strip of a metallic material having an operating tab 17*a* formed by folding one edge thereof by 90 degrees as shown in FIG. 31, and rectangular holes 16 are aligned at equal intervals. Each rectangular hole 16 is sized slightly greater than the aperture 8 of the cartridge bed plate 7 to accept the fitting member 15 on the cartridge bed plate 7 together with the outlet nozzle 9 extending from above.

In operation of the processing liquid cartridge storage apparatus 4*a* of this embodiment, when the processing liquid cartridge 5 is loaded onto the cartridge bed plate 7 as shown in FIG. 2, its outlet nozzles 9 extending downwardly enter the apertures 8 of the cartridge bed plate 7 and the holes 16 of the slide plate 17 (FIG. 29) and project downwardly and outwardly. At such time, the slide plate 17 is misaligned with the fitting members 15 about the apertures 8 of the cartridge bed plate 7 so that operating tab 17*a* is spaced from the cartridge bed plate 7, as shown in FIG. 27. Then, when the operating tab 17*a* of the slide plate 17 is pressed towards the fitting members 15 after the processing liquid cartridge 5 is loaded onto the cartridge bed plate 7, the inner edges 16*a* of respective holes 16 advance and engage with the annular recesses 9*a* of the outlet nozzles 9 thus urging the outlet nozzles 9 into the corresponding fitting members 15. This causes each outlet nozzle 9 to be correctly directed with the horse-shoe shaped fitting member 15 which securely engages with the annular recess 9*a* of the outlet nozzle 9 urged by the inner edge 16*a* of the slide plate 17. As a result, the outlet nozzles 9 are precisely aligned with the delivery nozzles 12 for processing liquids provided at given locations.

When the operating lever 14 of the lifting means 11 is turned, the support member 10 moves upward to join the delivery nozzles 12 mounted thereon with the corresponding outlet nozzles 9 held in place by a combination of the fitting members 15 and the slide plate 17. Accordingly, if the outlet nozzles 9 of the processing liquid cartridge 5 extend downwardly at adverse angles, they are urged against the corresponding fitting members 15 on the cartridge bed plate 7 by the slide plate 17 so that they are aligned with the respective delivery nozzles 12. Hence, the outlet nozzles 9 are accurately joined to the corresponding delivery nozzles 12 without leakage.

In this embodiment, the processing liquid cartridge 4*a* (4*b*) allows the outlet nozzles 9 of the processing liquid cartridge 5 loaded on the cartridge bed plate 7 to be joined with and separated from the corresponding delivery nozzles 12 by moving up and down the support member 10 which carries the delivery nozzles 12. It is also possible for the outlet nozzles 9 of the processing liquid cartridge 5 joining with and separating from the delivery nozzles 12 to move the cartridge bed plate 7 on which the processing liquid cartridge 5 is loaded by the operation of any lifting means while the support member 10 carrying the delivery nozzles 12 remains stationary in the processing liquid cartridge storage apparatus 4*a* (4*b*).

Figure 32:
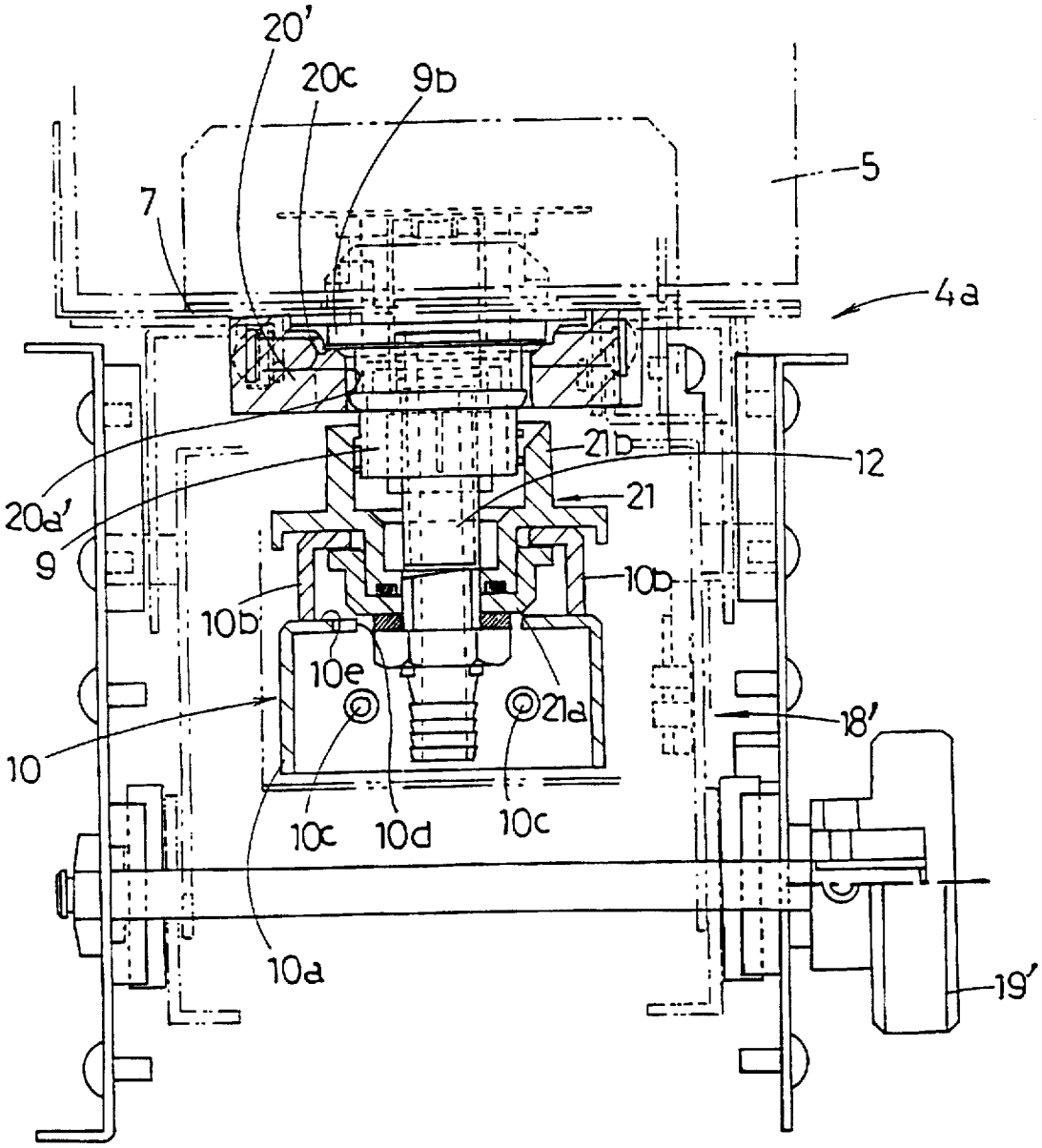
FIG. 32 is a cross sectional View of a primary part defined in Embodiment 5 of the present invention.

As shown in FIGS. 15 and 32, a processing liquid cartridge storage apparatus 4*a* (4*b*) of this embodiment permits the cartridge bed plate 7 on which the processing liquid cartridge 5 is loaded to be moved downwardly from its upper standby location by lifting means 18 (to a lower location shown in FIG. 15) for joining the outlet nozzles 9 of the processing liquid cartridge 5 with the corresponding delivery nozzles 12 on the support member 10 installed stationary in the apparatus 4*a*.

Also, it is possible that the delivery nozzles 12 on the support member 10 are moved upward by the lifting means 11 (FIG. 4) and joined to the corresponding outlet nozzles 9 extending downwardly from the processing liquid cartridge 5 which is placed on the cartridge bed plate 7 provided stationary in the processing liquid cartridge storage apparatus 4*a*.

As shown in FIG. 32, the cartridge bed plate 7 of the processing liquid cartridge storage apparatus 4*a* is moved up and down by turning forward and backward a knob 19' of lifting means 18' mounted beneath the cartridge bed plate 7 and composed of a link mechanism.

Figure 33:
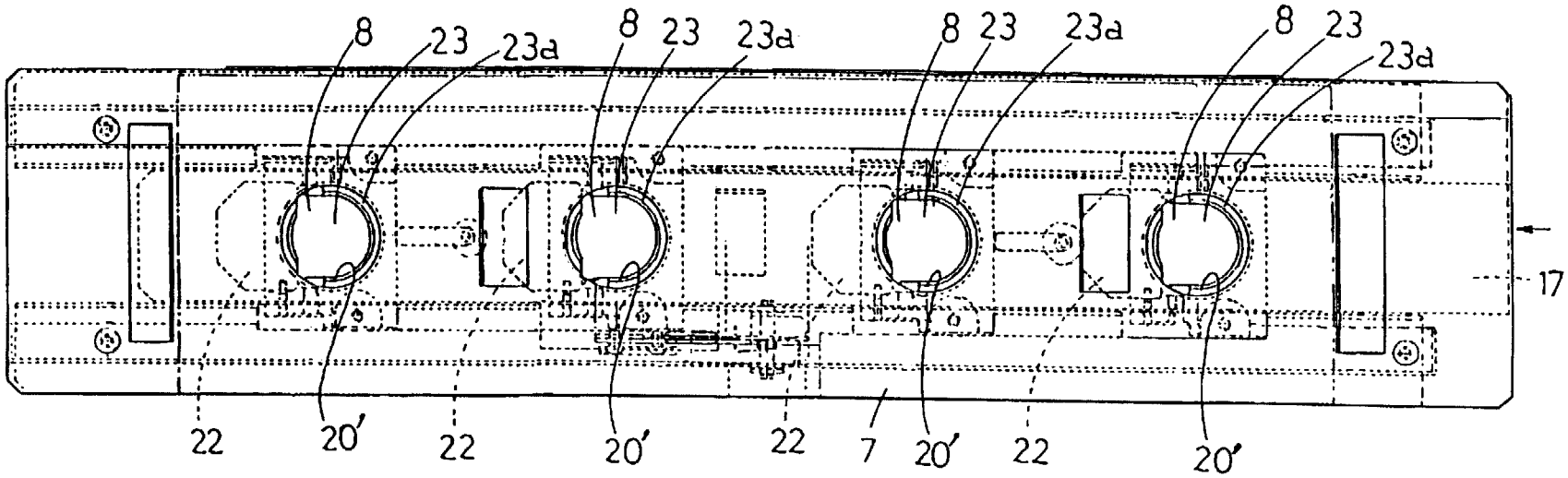
FIG. 33 is a plan view of a processing liquid cartridge storage apparatus defined in Embodiment 5 of the present invention.
Figure 34:
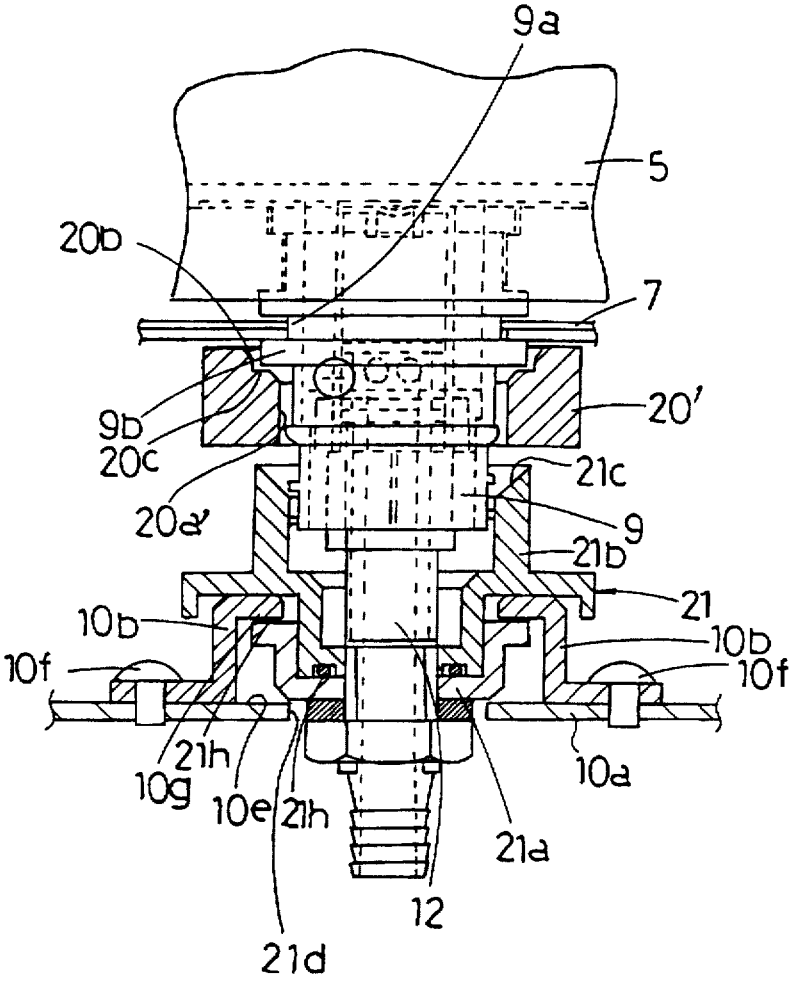
FIG. 34 is a cross sectional explanatory view of a sectional part defined in Embodiment 5 of the present invention.
Figure 35:
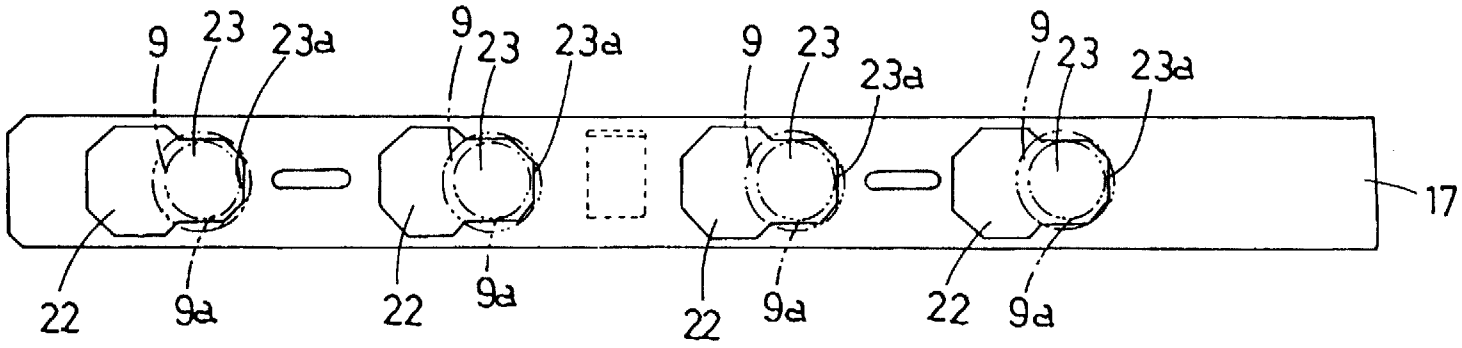
FIG. 35 is a plan view of a slide plate.

The cartridge bed plate 7 has a row of the apertures 8 provided therein at equal intervals as shown in FIG. 33. Each aperture 8 is of a round shape through which the outlet nozzle 9 of the processing liquid cartridge 5 (FIG. 32) loaded on the cartridge bed plate 7 is inserted to project downwardly. A corresponding number of guide members 20' are provided beneath the apertures 8 of the cartridge bed plate 7 for positioning the outlet nozzles 9 of the processing liquid cartridge 5 and are spaced by a few millimeters from the lower surface of the cartridge bed plate 7 as shown in FIGS. 32 and 34. The guide member 20' is made of a hard synthetic resin material and has a through hole 20*a*' in the center thereof. The through hole 20*a* is defined by a bevel 20*b* for guiding the outlet nozzle 9 and a step region 20*c* for engaging with a flange 9*b* of the outlet nozzle 9 for positioning. Also, the slide plate 17 which is a holding means is interposed between the cartridge bed plate 7 and the guide members 20' as shown in FIGS. 33 and 35. The slide plate 17 has the four outlet nozzle holes 22 provided therein at equal intervals for holding at once the outlet nozzles 9 of the processing liquid cartridge 5 extending through the corresponding apertures 8 of the cartridge bed plate 7 (FIG. 34), each outlet nozzle hole 22 communicating with an outlet nozzle holding hole 23 thus to form a connected hole pair.

When the processing liquid cartridge 5 is loaded onto the cartridge bed plate 7, its outlet nozzles 9 are inserted into the corresponding apertures 8 of the cartridge bed plate 7 and the outlet nozzle holes 22 of the slide plate 17 (through the through holes 20*a*' of the guide members 20'). The outlet nozzles 9 are fastened at once to the cartridge bed plate 7 by sliding the slide plate 17 in the direction of the arrow in FIG. 33 so that the annular recesses 9*a* of the outlet nozzles 9 are engaged with the inner edges 23*a* of the slide plate 17 at the outlet nozzle holding holes 23.

As shown in FIG. 32, the support member 10 of the processing liquid cartridge storage apparatus 4*a* extends lengthwisely in a center region of the same and comprises a C-shaped channel 10*a* and a pair of engaging members 10*b*. The C-shaped channel 10*a* is open downwardly and is fixedly mounted at both sides by screws 10*c* to the shell of the processing liquid cartridge storage apparatus 4*a*. The C-shaped channel 10*a* has openings 10*d* provided therein at locations aligned with the outlet nozzles 9 for accepting the delivery nozzles 12. Each opening 10*d* is greater in diameter than the delivery nozzle 12 which can thus be dislocated horizontally therein. The engaging members 10*b* spaced lengthwisely from each other are fixedly mounted by screws 10*f* (FIG. 34) to the upper side 10*e* of the C-shaped channel 10*a*.

Each of the delivery nozzles 12 is fixedly mounted to a holding member 21 which comprises a delivery nozzle retainer 21*a* and a delivery nozzle holder 21*b*. The delivery nozzle retainer 21*a* is located between the engaging member 10*b* and the C-shaped channel 10*a* and has an upper side 21*h* just under lower side log of engaging member 10*b*. The delivery nozzle holder 21*b* is fitted from the engaging member 10*b* side by a packing 21*d* into the delivery nozzle retainer 21*a*. The holding member 21 comprising the delivery nozzle retainer 21*a* and the delivery nozzle holder 21*b* is supported by the engaging members 10*b* for horizontal displacement in all directions. The delivery nozzle holder 21*b* has an inner taper surface 21*c* on the top thereof for ease of insertion of the outlet nozzle 9. The delivery nozzle 12 is fixedly fitted in the center of the holding member 21 opposite to the corresponding outlet nozzle 9 so that it projects upwardly and vertically. The delivery nozzle 12 can be displaced horizontally by the holding member 21 for adjustment.

In operation of the processing liquid cartridge storage apparatus 4*a*, when the processing liquid cartridge 5 is loaded onto the cartridge bed plate 7, the outlet nozzles 9 extending from its different processing liquid chambers pass through the apertures 8 of the cartridge bed plate 7 and the outlet nozzle holes 22 of the slide plate and enter the through holes 20*a*' of the guide members 20' under the lower side of the cartridge bed plate 7. This causes the flanges 9*b* of the outlet nozzles 9 to be engaged with and positioned by the step regions 20*c* in the through holes 20*a*' of the guide members 20'. Then, as the slide plate 17 is slid in, its inner edges 23*a* of the outlet nozzle holes 23 engage with the annular recesses 9*a* of the outlet nozzles 9 allowing the outlet nozzles 9 to be joined with the cartridge bed plate 7.

The turning of the knob 19' then causes the lifting means 18' to move down the outlet nozzles 9 on the cartridge bed plate 7. If any of the outlet nozzles 9 is tilted and extends not straight, it comes into contact with the taper surface 21*c* of the outlet nozzle holder 21*b* and hence, the holding member 21 itself is horizontally dislocated so that its outlet nozzle holder 21*b* is aligned with the center of the outlet nozzle 9. As the holding member 21 moves, the delivery nozzle 12 is dislocated horizontally to match the outlet nozzle 9. Accordingly, the outlet nozzle 9 when lowered further with the cartridge bed plate 7 can be joined with the delivery nozzle 12 with accuracy.

This embodiment allows the outlet nozzles 9 to be joined with the corresponding delivery nozzles 12 in correct alignment, thus preventing leakage of the processing liquids from the joints between the nozzles.

Figure 36:
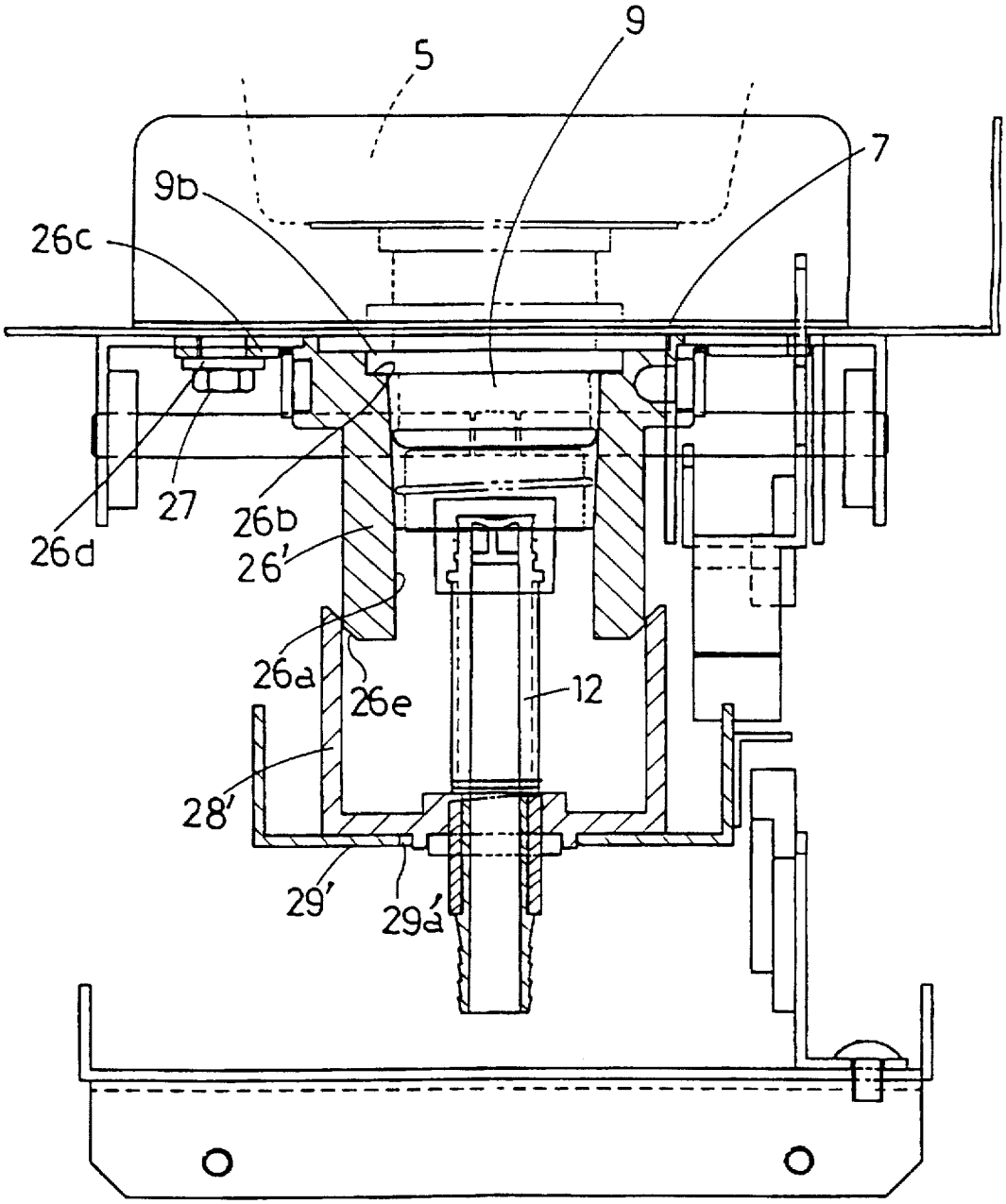
FIG. 36 is a cross sectional view of a primary part defined in Embodiment 5 of the present invention.
Figure 37:
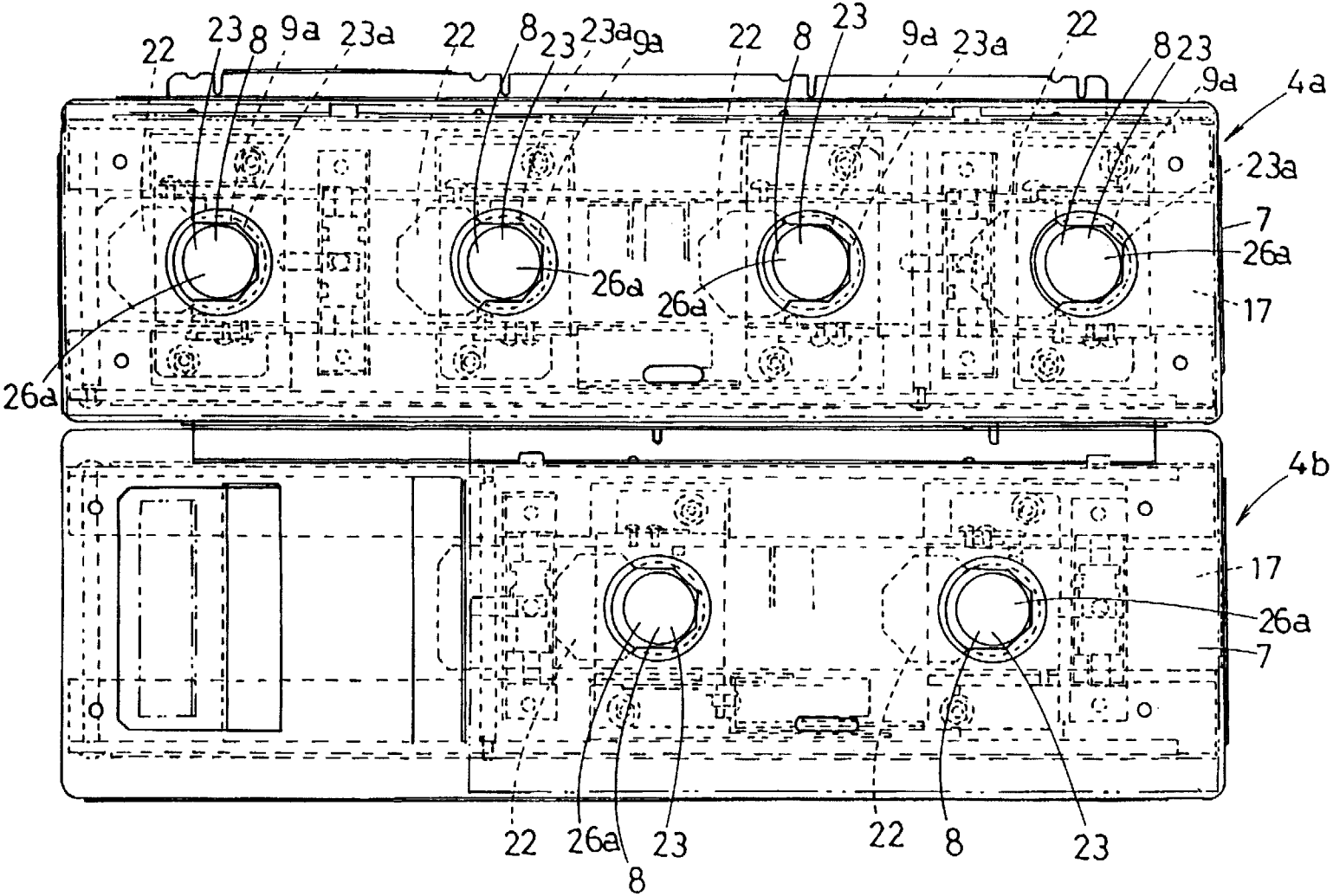
FIG. 37 is a plan view of a processing liquid cartridge storage apparatus defined in Embodiment 5 of the present invention.
Figure 38:
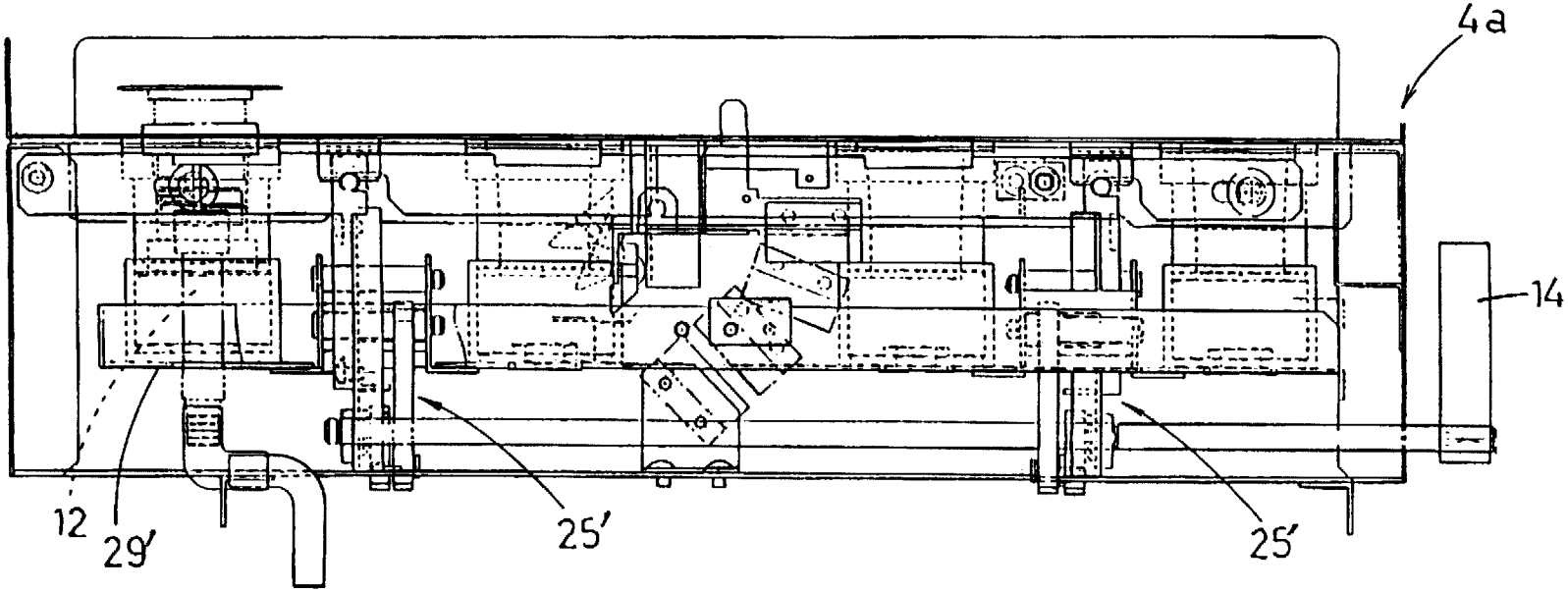
FIG. 38 is an explanatory view of an interior of the processing liquid cartridge storage apparatus defined in Embodiment 5 of the present invention.

As shown in FIGS. 36 to 38, each of processing liquid cartridge storage apparatuses 4*a* and 4*b* includes the cartridge bed plate 7 arranged stationary on which the processing liquid cartridge 5 (FIG. 2) is loaded, and support member 29' with the delivery nozzles 12 arranged movably upward and downward. The support member 29' is lifted up and down by the operation of a lifting means 25' for joining the delivery nozzles 12 thereon to the corresponding outlet nozzles 9 of the processing liquid cartridge 5 extending downwardly from the cartridge bed plate 7. It is also possible in the processing liquid cartridge storage apparatus 4*a* or 4*b* to move down the cartridge bed plate 7 together with the processing liquid cartridge 5 by a lifting means (such as denoted at 18' in FIG. 32) for joining the outlet nozzles 9 extending downwardly from the processing liquid cartridge 5 to the corresponding delivery nozzles 12 on the support member 10 installed stationary.

As shown in FIG. 37, the cartridge bed plate 7 has four apertures 8 provided therein at equal intervals. Each aperture 8 is of a round shape for accepting the outlet nozzle 9 of the processing liquid cartridge 5 (FIG. 36) loaded on the cartridge bed plate 7 so that the outlet nozzle 9 projects outward from the lower side of the cartridge bed plate 7.

A corresponding number of guide members 26' (FIG. 36) are provided beneath the apertures 8 of the cartridge bed plate 7 for positioning the outlet nozzles 9 of the processing liquid cartridge 5 and are spaced by a few millimeters from the lower surface of the cartridge bed plate 7. The guide member 26' is a hard synthetic resin material of a cylindrical shape and has a through hole 26*a* in the center thereof. The through hole 26*a* is associated with a step region 26*b* provided on an upper inner side of the guide member 26' for engaging with a flange 9*b* of the outlet nozzle 9 for positioning. The guide member 26' also has a flange 26*c* provided on the upper end thereof with an opening 26*d*. The opening 26*d* is greater in diameter than a retainer bolt 27 which depends from the lower side of the cartridge bed plate 7 for movably joining the guide member 26' to the cartridge bed plate 7 for horizontal adjustment. The guide member 26' has a bevel 26*e* on the lower end thereof for ease of engagement with a respective engaging member 28' which is mounted to support member 29' and will be described later.

The slide plate 17 which is a holding means (FIG. 37) is slidably interposed between the cartridge bed plate 7 and the guide members 26'. The construction of the slide plate 17 is identical to that explained above and will not be explained in further detail.

As shown in FIGS. 36 and 38, the support member 29' of the processing liquid cartridge storage apparatus 4*a* (4*b*) extends lengthwisely in a center region of the same and comprises a C-shaped channel which is open upwardly and is supported by lifting means 25'. The support member 29' has a row of holes 29*a*' provided along and in a center region thereof. The engaging members 28' having a C shape in cross section are movably fitted into the holes 29*a*' of the support member 29' with their openings facing upwards. Provided in the center of each engaging member 28' is the delivery nozzle 12 which extends vertically and upwardly and is aligned with the corresponding outlet nozzle 9 hanging from above. The delivery nozzle 12 is dislocated as the engaging member 28' moves horizontally. The engaging member 28' is arranged to move horizontally relative to the corresponding guide member 26' on the cartridge bed plate 7.

In the operation of the processing liquid cartridge storage apparatus 4*a* or 4*b* (FIG. 37), when the processing liquid 6artridge 5 is loaded onto the cartridge bed plate 7, the outlet nozzles 9 extending downwardly from its different processing liquid chambers pass through the apertures 8 of the cartridge bed plate 7 and the outlet nozzle holes 22 of the slide plate 17 and enter the through holes 26*a* of the guide members 26' beneath the cartridge bed plate 7. If any of the outlet nozzles 9 of the processing liquid cartridge 5 is misaligned with the through hole 26*a* of the corresponding guide member 26', its movement into the through hole 26*a* causes the guide member 26' to be horizontally dislocated for correct alignment, thus locating the outlet nozzle 9 in the outlet nozzle holding hole 23. Simultaneously, the flange 9*b* of the outlet nozzle 9 is engaged with step region 26*b* of the guide member 26' in the through hole 26*a*, hence positioning the outlet nozzle 9 relative to the cartridge bed plate 7. Then, the slide 17 is slid in so that its inner edges 23*a* at the outlet nozzle holding holes 23 come into engagement with the annular recesses 9*a* of the outlet nozzles 9 as shown in FIG. 37, thus joining the outlet nozzles 9 to the cartridge bed plate 7.

Figure 39:
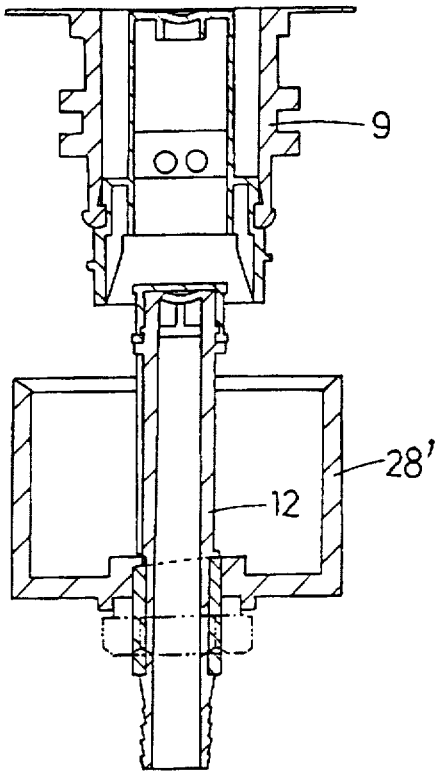
FIG. 39 is a longitudinal cross sectional explanatory view showing an outlet nozzle and a corresponding delivery nozzle separated from each other in the primary part defined in Embodiment 5 of the present invention.
Figure 40:
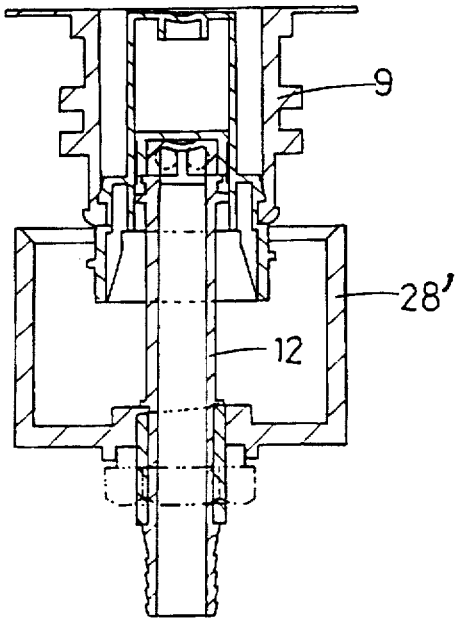
FIG. 40 is a longitudinal cross sectional explanatory view showing the outlet nozzle and the corresponding delivery nozzle connected to each other in the primary part defined in Embodiment 5 of the present invention.

This is followed by the operating lever 14 of the lifting means 25' (FIG. 38) turning to lift up the support member 29' and thus the engaging members 28' carrying the corresponding delivery nozzles 12. Accordingly, the guide members 26' are allowed to engage at the lower end with the openings of the respective engaging members 28' (FIG. 36). Even if the guide members 26' and the upwardly moving engaging members 28' are misaligned with each other, they are horizontally dislocated from each other upon physical contact to align the outlet nozzles 9 with the corresponding delivery nozzles 12 and join them to each other with accuracy as shown in FIGS. 39 and 40.

Embodiment 6

Figure 43:
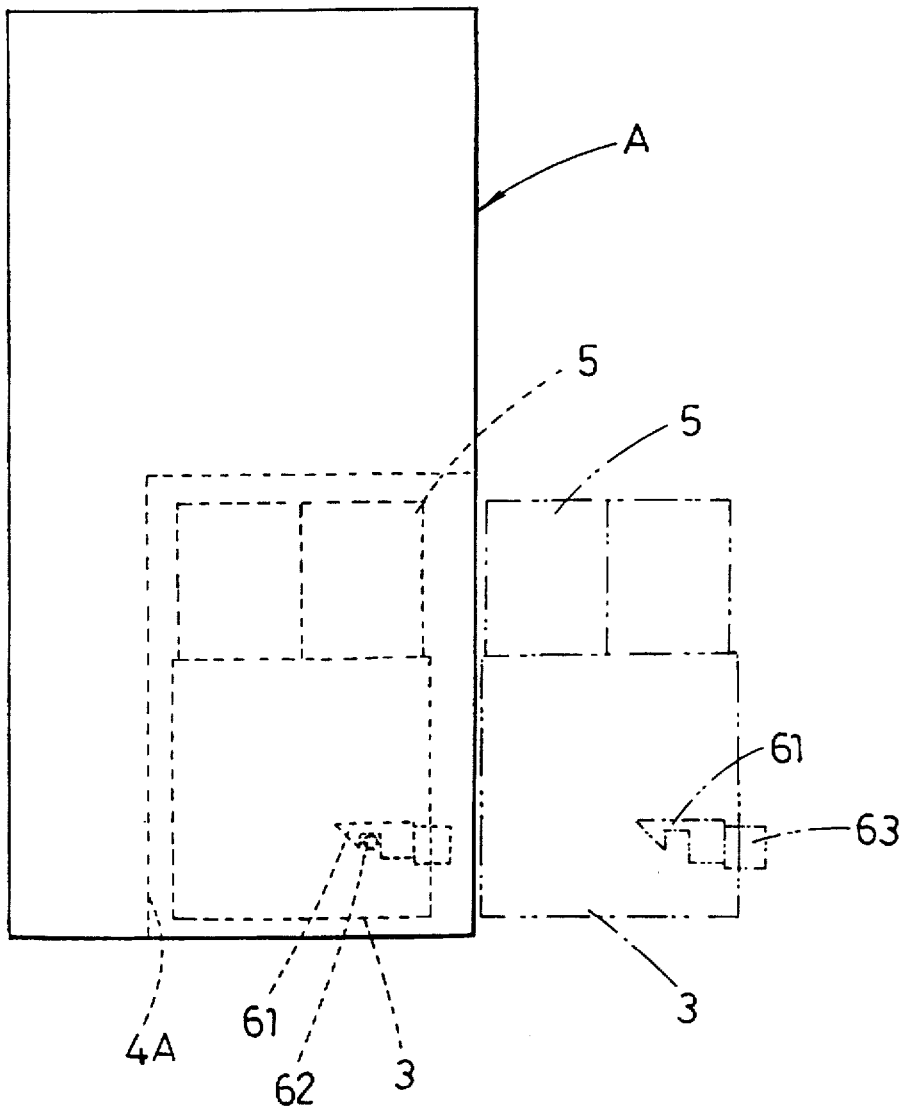
FIG. 43 is a view showing operation of Embodiment 6.
Figure 44:
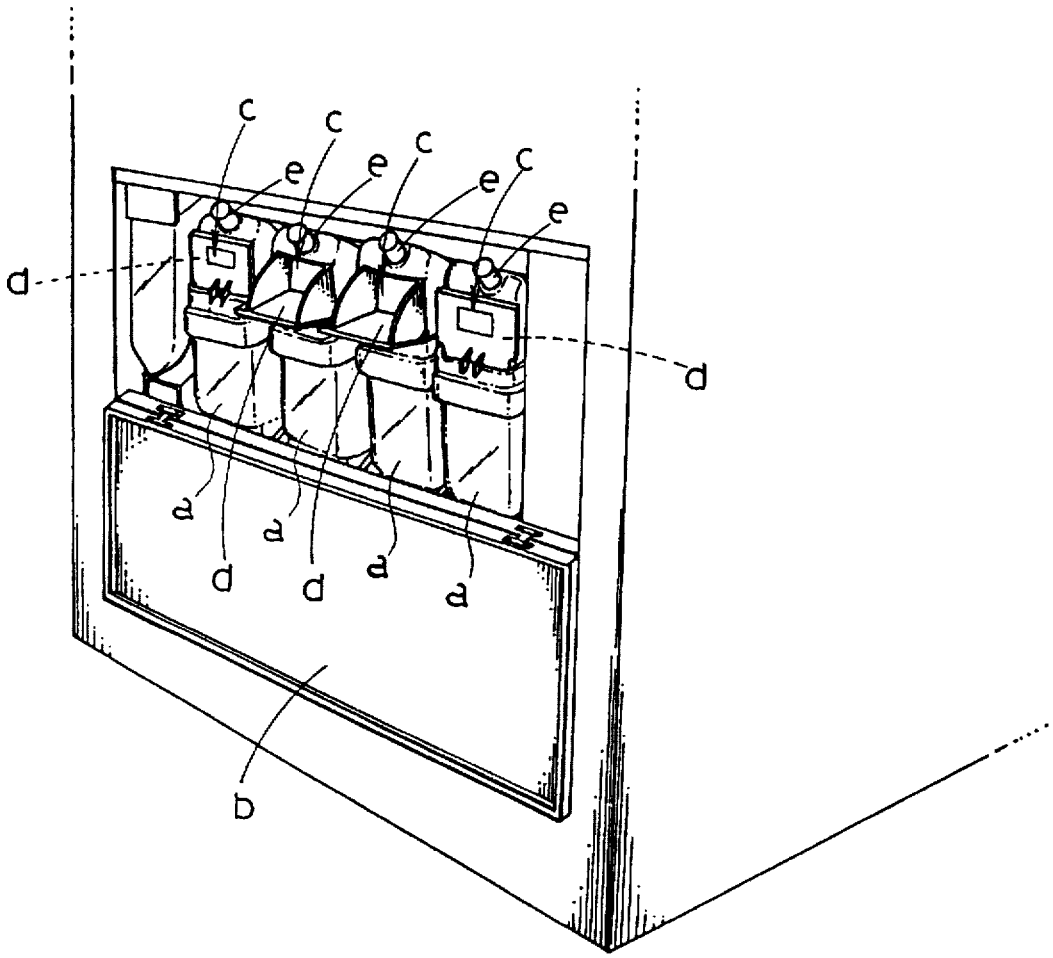
PRIOR ART Fig.44
FIG. 44 is a perspective view of a conventional photographic processing apparatus.
Figure 45:
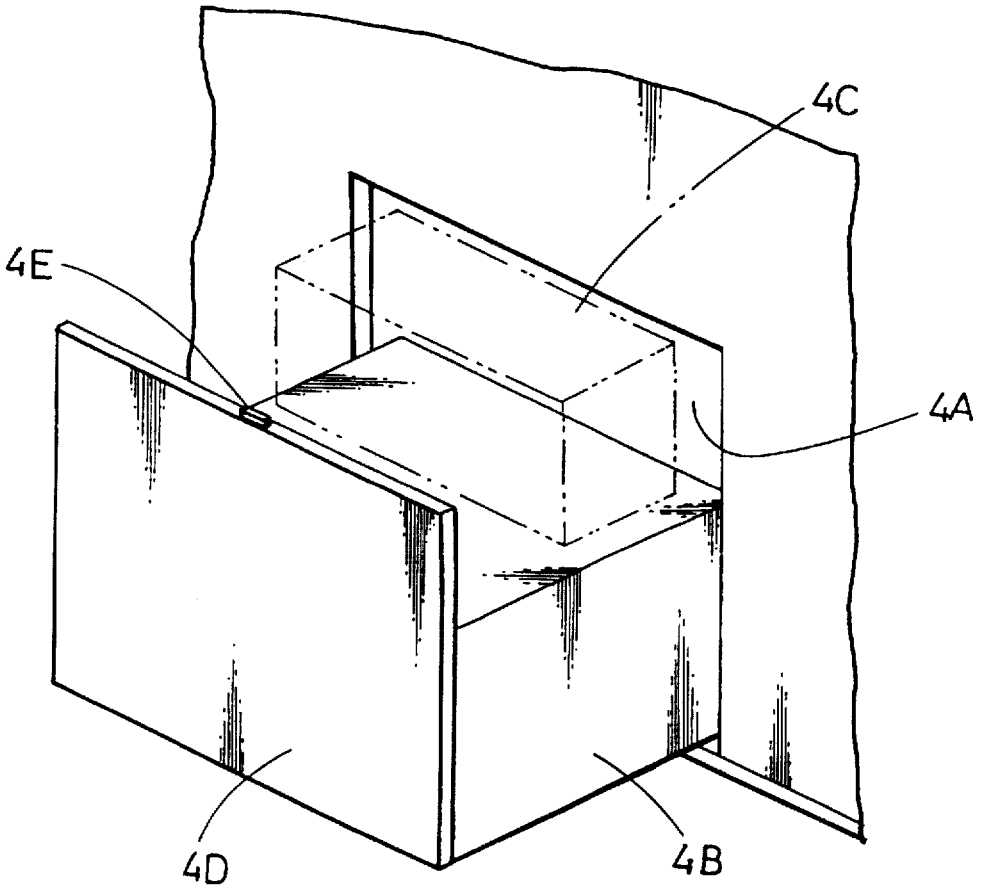
PRIOR ART Fig.45
FIG. 45 is a perspective view of a conventional photographic processing apparatus.

A photographic processor apparatus A (FIG. 43) of Embodiment 6 includes a processing station for developing exposed photosensitive materials (not shown) supplied with relevant processing liquids from a processing liquid cartridge 5 loaded onto a drawer base 3. A drawer base storage 4A is provided in a housing 3*a* of the apparatus. The housing 3*a* has a storage opening 41 provided in a side thereof for accessing the drawer base storage 4A. The drawer base 3 is installed in the drawer base storage 4A and can be moved out through the storage opening 41. Two movable rails 12' are mounted to both side walls 11' of the drawer base 3. There are provided stationary rollers 42 and rails 43 at both sides of the drawer base storage 4A for supporting the movable rails 12' and for guiding movable rollers 13' mounted on the drawer base 3. Also, a stopper 44 is mounted adjacent to the front end of each stationary rail 43 for limiting the movement of the movable rollers 13'. The drawer base 3 can thus be drawn out through the opening 41 from the drawer base storage 4A by the operation of a supporting means composed of the rails 12' and 43 and the rollers 13' and 42.

The drawer base 3 includes a liquid supplying means 1A such as a supply conduit or tubing. The drawer base 3 has a top plate 7' on which the processing liquid cartridge 5 is detachably loaded. When the processing liquid cartridge 5 is loaded, its filling outlets are connected to the corresponding liquid supply tubings. When the processing liquid cartridge 5 is exhausted, it is replaced with another liquid filled cartridge.

A pair of doors 5' are provided for closing the storage opening 41 of the drawer base storage 4A and are mounted by hinges 51 to the housing 3*a*.

Figure 41:
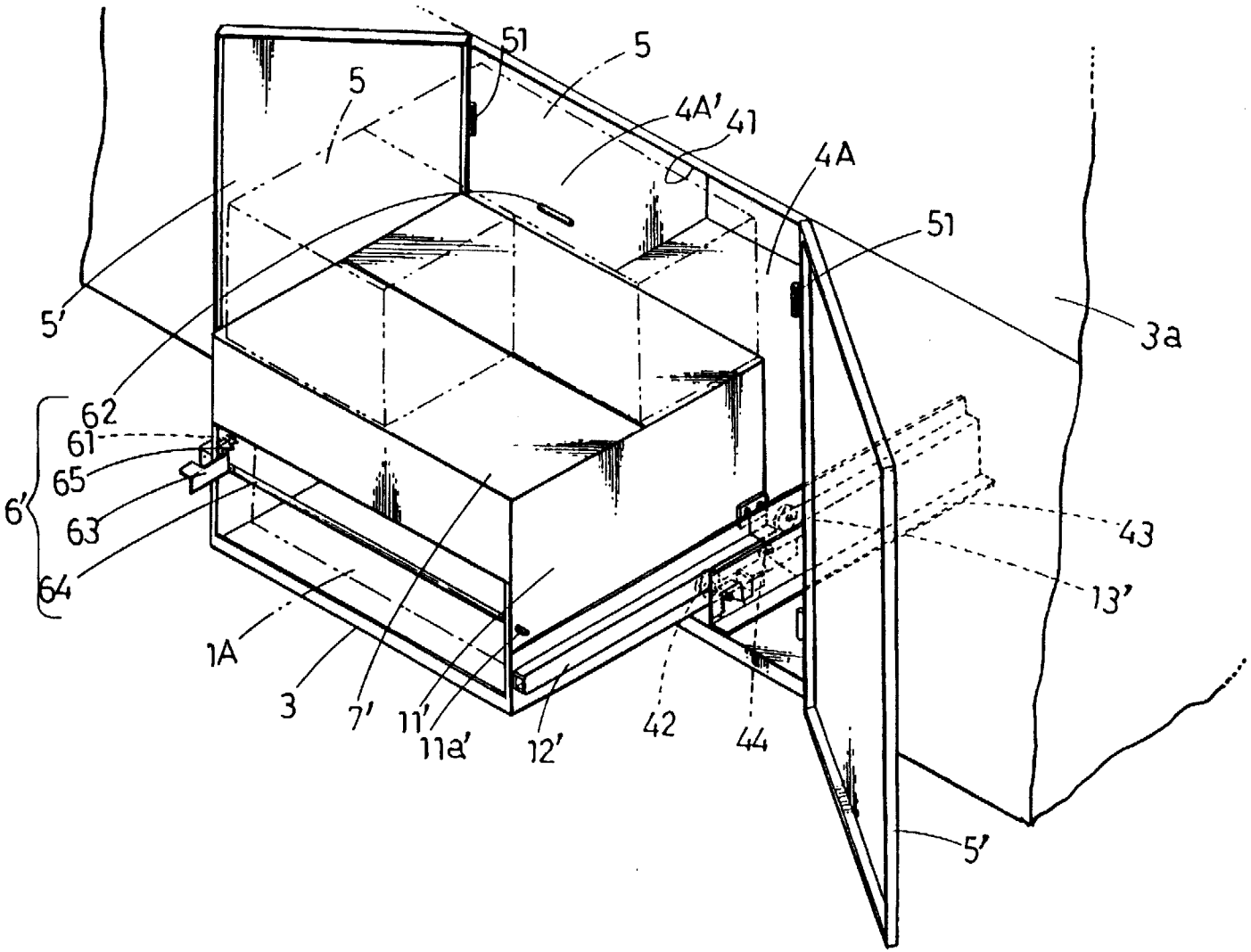
FIG. 41 is a perspective view of a photographic processing apparatus according to an embodiment 6 of the present invention.
Figure 42:
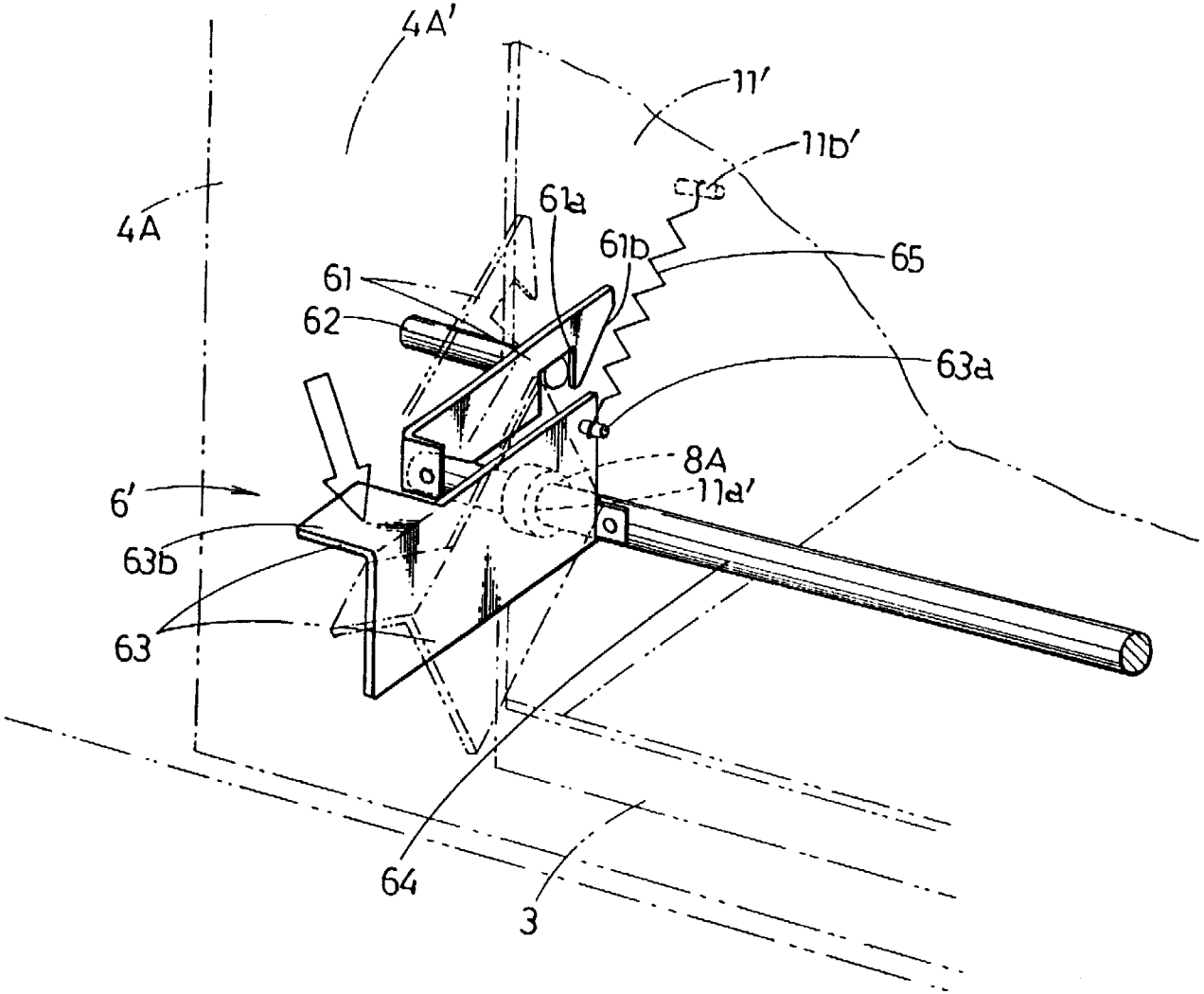
FIG. 42 is a perspective view of a lock mechanism of Embodiment 6.

As shown, a lock mechanism 6' is provided for disabling the outward movement of the drawer base 3. The lock mechanism 6' comprises, as shown in FIGS. 41 and 42, a hook 61 (a part of engaging means on the drawer base 3), an engaging pin 62 (a part of the engaging means on the drawer base storage 4*a* for engagement with the hook 61, a release lever 63 for releasing the locking of the drawer base 3 a rotary shaft 64, and a tension spring 65. The hook 61 has an engaging notch 61*a* provided in the lower side thereof and a taper edge 61*b* provided on the distal end thereof. The release lever 63 is formed with a press-down tab 63*b*. The engaging pin 62 projects inwardly from an inner wall 4A' of the drawer base storage 4A.

Each side wall 11' of the drawer base 3 is provided with an insertion hole 11*a'* at a front end region thereof. The rotary shaft 64 of the lock mechanism 6' is crosswisely mounted with both ends inserted into the two insertion holes 11*a'* of the two side walls 11'. More particularly, the rotary shaft 64 is also supported by two bearings 8A fitted into the two insertion holes 11a'. The hook 61 is joined to one end of the rotary shaft projected from the side wall 11' so that it turns as the rotary shaft 64 rotates. The release lever 63 is also joined to the end of the rotary shaft 64 inside the side wall 11' so that it swings as the rotary shaft 64 rotates. The release lever 63 has a projection 63*a* while the side wall 11' of the drawer base 3 is provided with a projection 11*b'*. The tension spring 65 is mounted between the two projections 63*a* and 11*b'*. The hook 61 remains urged by the tension spring 65 in a locking direction. Hence, the hook 61 extends horizontally (as shown by the solid lines in FIG. 42) when no tension is applied to the spring 65 by the release lever 63. The doors 5' can be locked by a door lock mechanism (not shown).

The action of replacing an exhausted processing liquid cartridge 5 with an unused one in the photographic processor apparatus A will be explained. Operation starts with opening the doors 5' and depressing the release lever 63 against the urging force of the tension spring 65 to turn up the hook 61. When the hook 61 is disengaged from the engaging pin 62, the drawer base 3 is pulled out from the drawer base storage 4A. Then, the exhausted processing liquid cartridge 5 is removed from the drawer base 3 and a replacement is loaded onto the drawer base 3. This is followed by pressing the drawer base 3 into the drawer base storage 4A. The inward movement of the drawer base 3 causes the taper end 61*b* of the hook 61 to strike the engaging pin 62 and turn upward on the same against the urging force of the tension spring 65. When the drawer base 3 further moves inwardly, the hook 61 turns down allowing its engaging notch 61*a* to engage with the engaging pin 62. As a result, the drawer base 3 on which the new processing liquid cartridge 5 is loaded is set and locked in the drawer base storage 4A. Then, the doors 5' are shut to close the storage opening 41 of the drawer base storage 4A.

The storage opening 41 of the drawer base storage 4A may be provided in any side of the photographic processor apparatus A.

We claim:

1. A processing liquid cartridge storage apparatus in an automatic development processing system for automatically developing photosensitive materials, said storage apparatus comprising:

a processing liquid cartridge filled with at least two separately stored, different processing liquids and detachably loaded onto a cartridge bed plate installed in the automatic development processing system, said processing liquid cartridge having outlet nozzles extending from chambers in which said at least two different processing liquids are separately stored, said outlet nozzles being arranged to fit into corresponding apertures provided in said cartridge bed plate; and a slide plate slidably mounted beneath said cartridge bed plate and having therein at least two pairs of connected holes spaced at equal intervals, each said pair comprising an outlet nozzle accepting hole for accepting the corresponding said outlet nozzle and an outlet nozzle engaging hole communicated with said outlet nozzle accepting hole, whereby when said outlet nozzles of said processing liquid cartridge are inserted simultaneously through the corresponding said apertures of said cartridge bed plate into said outlet nozzle accepting holes of said slide plate, said slide plate is slid forward to allow inner edges at said outlet nozzle engaging holes to engage with annular recesses provided in peripheries of said outlet nozzles, thus securing said outlet nozzles of said processing liquid cartridge to said cartridge bed plate at the same time.

2. A processing liquid cartridge storage apparatus in an automatic development processing system for automatically developing photosensitive materials, said storage apparatus comprising:

a processing liquid cartridge filled with at least two separately stored, different processing liquids and detachably loaded onto a cartridge bed plate installed in the automatic development processing system, said processing liquid cartridge having outlet nozzles extending from chambers in which said at least two different processing liquids are separately stored, said outlet nozzles being arranged to fit into corresponding apertures provided in said cartridge bed plate; and a support member carrying thereon a group of processing liquid delivery nozzles corresponding to said outlet nozzles fitted in said apertures of said cartridge bed plate and arranged to be moved up and down by a lifting means, whereby when said support member is moved up, said delivery nozzles are securely connected at the same time to corresponding said outlet nozzles of said processing liquid cartridge.

3. A processing liquid cartridge storage apparatus in an automatic development processing system for automatically developing photosensitive materials, said storage apparatus comprising:

a processing liquid cartridge filled with at least two separately stored, different processing liquids and detachably loaded onto a cartridge bed plate installed in the automatic development processing system, said processing liquid cartridge having outlet nozzles extending from chambers in which said at least two different processing liquids are separately stored, said outlet nozzles being arranged to fit into corresponding apertures provided in said cartridge bed plate; and a support member carrying thereon a group of processing liquid delivery nozzles corresponding to said outlet nozzles fitted in said apertures of said cartridge bed plate, said support member being mounted stationarily beneath said cartridge bed plate, and said cartridge bed plate being arranged to be moved up and down by a lifting means, whereby when said cartridge bed plate is moved down, said outlet nozzles of said processing liquid cartridge are securely connected at the same time to corresponding said delivery nozzles of said support member.

4. A processing liquid cartridge storage apparatus in an automatic development processing system for automatically developing photosensitive materials, said storage apparatus comprising:

a processing liquid cartridge filled with at least two separately stored, different processing liquids and detachably loaded onto a cartridge bed plate installed in the automatic development processing system, said processing liquid cartridge having outlet nozzles extending from chambers in which said at least two different processing liquids are separately stored, said outlet nozzles being arranged to fit into corresponding apertures provided in said cartridge bed plate; and a group of guide members mounted to corresponding said apertures of said cartridge bed plate, each said guide member having therein an outlet nozzle accepting hole having an inner guiding edge that is beveled for ease of insertion of a corresponding said outlet nozzle, whereby said outlet nozzles of the processing liquid cartridge may be correctly fitted at the same time into said corresponding apertures of said cartridge bed plate.

5. A processing liquid cartridge storage apparatus in an automatic developing processing system for automatically developing photosensitive materials, said storage apparatus comprising:

a processing liquid cartridge filled with at least two separately stored, different processing liquids and detachably loaded onto a cartridge bed plate installed in the automatic development processing system, said processing liquid cartridge having outlet nozzles extending from chambers in which said at least two different processing liquids are separately stored, said outlet nozzles being arranged to fit into corresponding apertures provided in said cartridge bed plate;

a slide plate slidably mounted beneath said cartridge bed plate and having at least two pairs of connected holes spaced at equal intervals, each said pair comprising an outlet nozzle accepting hole for accepting the corresponding said outlet nozzle and an outlet nozzle engaging hole communicated with said outlet nozzle accepting hole, and said slide plate having on a lower side thereof a contact tab; and a support member mounted beneath said slide plate and being equipped with processing liquid delivery nozzles corresponding to said outlet nozzles, said support member having on an upper side thereof a stopper tab, whereby when said outlet nozzle accepting holes of said slide plate are aligned with the corresponding said apertures of said cartridge bed plate, said slide plate causes said contact tab to hold said stopper tab thus preventing upward movement of said support member, and when said slide plate is slid forward to align said outlet nozzle engaging holes with said apertures of said cartridge bed plate and to hold with inner edges of said outlet nozzle engaging holes said outlet nozzles of said processing liquid cartridge, said contact tab is spaced from said stopper tab to said support member thus allowing said support member to move upwardly.

6. A processing liquid cartridge storage apparatus in an automatic development processing system according to claim 5, wherein a sensor is mounted on said support member and said cartridge bed plate for detecting upward movement of said support member to a predetermined level or downward movement of said cartridge bed plate to a predetermined level.

7. A processing liquid cartridge storage apparatus in an automatic development processing system for automatically developing photosensitive materials, said storage apparatus comprising:

a processing liquid cartridge filled with at least two separately stored, different processing liquids and detachably loaded onto a movable cartridge bed plate installed in the automatic development processing system, said processing liquid cartridge having outlet nozzles extending from chambers in which said at least two different processing liquids are separately stored, said outlet nozzles being arranged to fit into corresponding apertures provided in said cartridge bed plate;

a slide plate slidably mounted beneath said cartridge bed plate and having at least two pairs of connected holes spaced at equal intervals, each said pair comprising an outlet nozzle accepting hole for accepting the corresponding said outlet nozzle and an outlet nozzle engaging hole communicated with said outlet nozzle accepting hole, and said slide plate having on a lower side thereof a contact tab; and a support member mounted stationarily beneath said slide plate and being equipped with processing liquid delivery nozzles corresponding to said outlet nozzles, said support member having on an upper side thereof a stopper tab, whereby when said outlet nozzle accepting holes of said slide plate are aligned with corresponding said apertures of said cartridge bed plate, said slide plate causes said contact tab to engage with said stopper tab thus preventing downward movement of said cartridge bed plate, and when said slide plate is slid forward to align said outlet nozzle engaging holes with said apertures of said cartridge bed plate and to hold with inner edges of said outlet nozzle engaging holes said outlet nozzles of said processing liquid cartridge, said contact tab is spaced from said stopper tab of said support member thus allowing said cartridge bed plate to move downwardly.

8. A processing liquid cartridge storage apparatus in an automatic development processing system according to claim 7, wherein a sensor is mounted on said support member and said cartridge bed plate for detecting upward movement of said support member to a predetermined level or downward movement of said cartridge bed plate to a predetermined level.

9. A processing liquid cartridge storage apparatus in which when a processing liquid cartridge having a group of outlet nozzles extending from different processing liquid chambers thereof arranged separately is loaded onto a cartridge bed plate which is formed with apertures corresponding to said outlet nozzles, said outlet nozzles, each having an annular recess provided in a periphery thereof, are fitted into corresponding said apertures of said cartridge bed plate, are secured by a securing means to said cartridge bed plate, and are joined at the same time with processing liquid delivery nozzles mounted on a support member beneath said cartridge bed plate by a moving means moving upwardly said support member with said delivery nozzles or moving downwardly said cartridge bed plate with said outlet nozzles comprising:

fitting member mounted on a lower side of said cartridge bed plate, each said fitting member being located about a respective said aperture of said cartridge bed plate and having a horse-shoe shape for detachably fitting into said annular recess of the corresponding said outlet nozzle; and a slide member slidably mounted beneath said cartridge bed plate and having outlet nozzle holes provided therein, whereby said outlet nozzles of said processing liquid cartridge lowered into said apertures of said cartridge bed plate and said outlet nozzle holes of said slide plate are securely joined to said cartridge bed plate when said slide plate is slid forward to hold said annular recess of each said outlet nozzle from one direction with an inner edge of a respective said outlet nozzle hole of said slide plate and from three other directions by the respective said fitting member.

10. A processing liquid cartridge storage apparatus in which when a processing liquid cartridge having a group of outlet nozzles extending from different processing liquid chambers thereof arranged separately is loaded onto a cartridge bed plate which is formed with apertures corresponding to said outlet nozzles, said outlet nozzles, each having an annular recess provided in a periphery thereof, are fitted into corresponding said apertures of said cartridge bed plate, are secured by a securing means to said cartridge bed plate, and are joined at the same time with processing liquid delivery nozzles mounted on a support member beneath said cartridge bed plate by a moving means moving upwardly said support member with said delivery nozzles or moving downwardly said cartridge bed plate with said outlet nozzles, comprising:

guide members mounted stationarily beneath said cartridge bed plate, each said guide member being located about a respective said aperture of said cartridge bed plate and having an outlet nozzle through hole provided therein for positioning a respective said outlet nozzle; and holding members movably mounted on said support member, each said holding member being arranged to accept a respective said outlet nozzle and being joined with a corresponding said delivery nozzle, whereby said outlet nozzles of said processing liquid cartridge held and positioned by respective said guide members are securely connected by operation of said moving means to said corresponding delivery nozzles which are aligned by displacement of said holding members upon said delivery nozzles moving into said holding members.

11. A processing liquid cartridge storage apparatus in which when a processing liquid cartridge having a group of outlet nozzles extending from different processing liquid chambers thereof arranged separately is loaded onto a cartridge bed plate which is formed with apertures corresponding to said outlet nozzles, said outlet nozzles, each having an annular recess provided in a periphery thereof, are fitted into corresponding apertures of said cartridge bed plate, are secured by a securing means to said cartridge bed plate, and are joined at the same time with processing liquid delivery nozzles mounted on a support member beneath said cartridge bed plate by a moving means moving upwardly said support member with said delivery nozzles or moving downwardly said cartridge bed plate with said outlet nozzles, comprising:

guide members movably mounted beneath said cartridge bed plate, each said guide member being located about a respective said aperture of said cartridge bed plate and having an outlet nozzle through hole provided therein for positioning a respective said outlet nozzle; and engaging members movably mounted on said support member, each said engaging member being arranged to engage with a lower side of a respective said guide member and joined with a corresponding said delivery nozzle, whereby said outlet nozzles of said processing liquid cartridge are securely connected to corresponding said delivery nozzles by operation of said moving means causing engagement of each said movable guide member with a corresponding said engaging member for precise alignment.

12. A photographic processing apparatus comprising:

a drawer base storage arranged in a housing one side of which is formed with a storage opening;

opening and closing doors mounted to said housing for closing said storage opening for said drawer base storage;

a drawer base, on which a processing liquid tank is loaded and installed, arranged in said drawer base storage for inward and outward movements through said storage opening; and a pair of engaging members, one mounted on said drawer base and the other mounted in said drawer base storage, operable to be engaged with each other to lock said drawer base when said drawer base is moved into said drawer base storage.

* * * * *